US011766871B2

(12) United States Patent
Okai et al.

(10) Patent No.: US 11,766,871 B2
(45) Date of Patent: Sep. 26, 2023

(54) PRINTING DEVICE AND FILTER

(71) Applicant: BROTHER KOGYO KABUSHIKI KAISHA, Nagoya (JP)

(72) Inventors: Shunsuke Okai, Nagoya (JP); Akihiro Kawakita, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/489,906

(22) Filed: Sep. 30, 2021

(65) Prior Publication Data

US 2022/0097403 A1 Mar. 31, 2022

(30) Foreign Application Priority Data

Sep. 30, 2020 (JP) ..... 2020-165855

(51) Int. Cl.
*B41J 2/175* (2006.01)
*B41J 29/02* (2006.01)
*B41J 29/13* (2006.01)

(52) U.S. Cl.
CPC ..... *B41J 2/17563* (2013.01); *B41J 29/02* (2013.01); *B41J 29/13* (2013.01)

(58) Field of Classification Search
CPC ..... B41J 2/17563; B41J 29/02; B41J 29/13
See application file for complete search history.

(56) References Cited

U.S. PATENT DOCUMENTS

| | | | | |
|---|---|---|---|---|
| 9,550,369 | B2 * | 1/2017 | Nakata | B41J 2/1714 |
| 2009/0021548 | A1 | 1/2009 | Suzuki et al. | |
| 2011/0109693 | A1 | 5/2011 | Ohnishi | |
| 2015/0151537 | A1 | 6/2015 | Ohnishi et al. | |
| 2015/0266309 | A1 | 9/2015 | Nakata | |
| 2018/0099503 | A1 | 4/2018 | Harada et al. | |
| 2018/0126741 | A1 | 5/2018 | Hasegawa et al. | |
| 2019/0111684 | A1 | 4/2019 | Ozawa et al. | |
| 2019/0263133 | A1 | 8/2019 | Hiruma | |
| 2020/0269585 | A1 | 8/2020 | Izawa et al. | |

FOREIGN PATENT DOCUMENTS

| | | | |
|---|---|---|---|
| CN | 104364082 | A | 2/2015 |
| CN | 108883638 | A | 11/2018 |
| CN | 110181953 | A | 8/2019 |
| EP | 3702161 | A1 | 9/2020 |
| JP | 2009023159 | A | 2/2009 |
| JP | A-2010-012680 | | 1/2010 |
| JP | 2017077699 | A | 4/2017 |
| JP | 2017128060 | A | 7/2017 |
| JP | 2018075720 | A | 5/2018 |
| JP | 6604858 | B2 | 11/2019 |

OTHER PUBLICATIONS

European Search Report dated Feb. 21, 2022, in corresponding European Application No. 21200103.6 (8 pages).
Office Action issued in related Chinese Patent Application No. 202111161618.2, dated Feb. 17, 2023. (7 pages.).

* cited by examiner

*Primary Examiner* — Geoffrey S Mruk
(74) *Attorney, Agent, or Firm* — K&L Gates LLP

(57) ABSTRACT

A printing device includes an inkjet head, a filter accommodating portion, a filter configured to be accommodated in the filter accommodating portion and extending in a given direction from one end to the other end of the filter to collect mist, and a grip portion provided at least one of the one end or the other end of the filter. The grip portion includes a handle protruding from the filter, a recessed portion recessed inside the filter, or a hole.

28 Claims, 15 Drawing Sheets

FIG. 3A
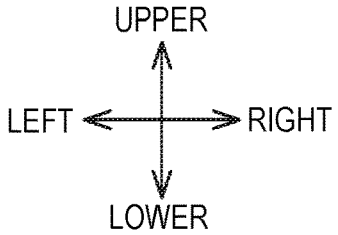
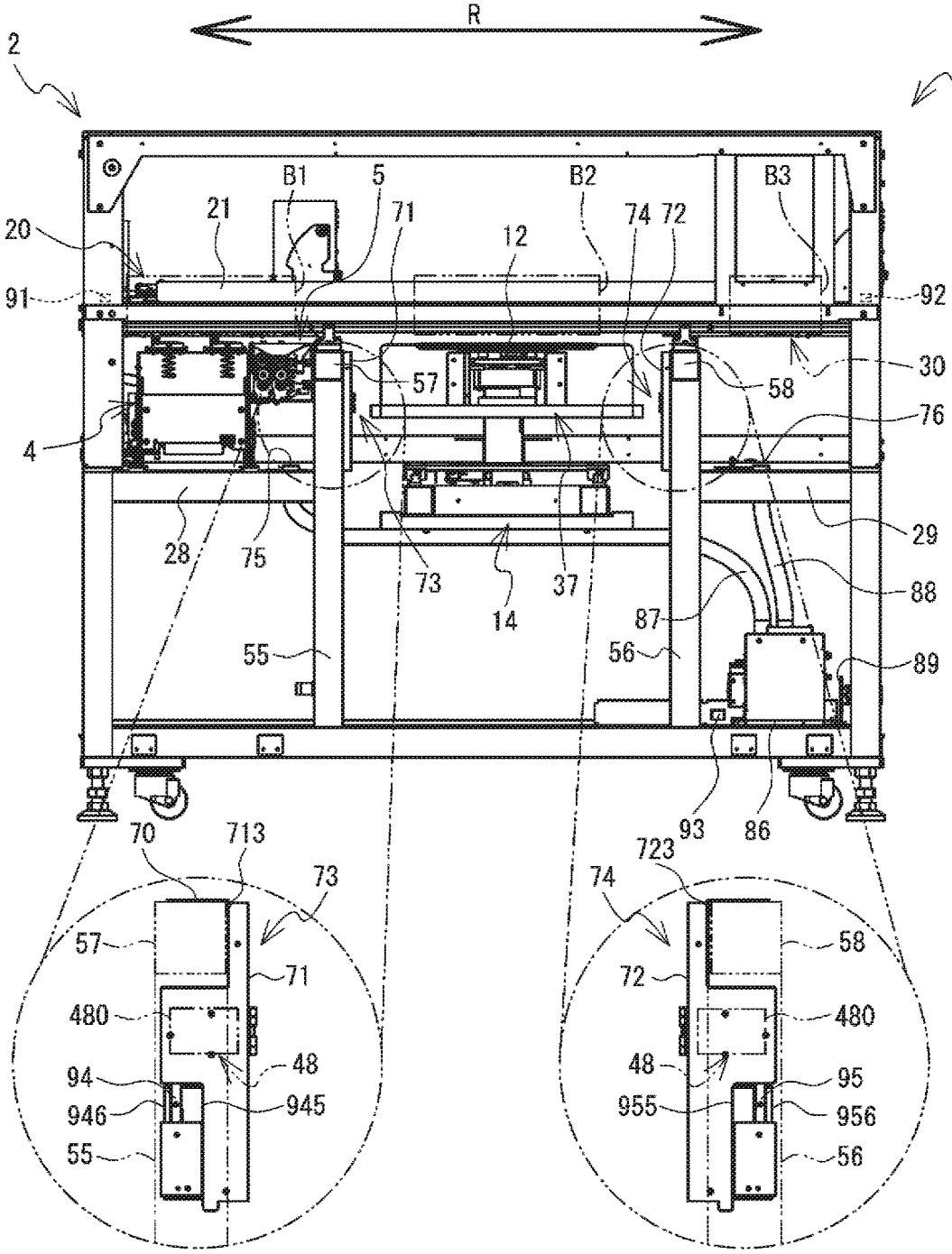
FIG. 3B FIG. 3C

PRINTING DEVICE AND FILTER

CROSS-REFERENCE TO RELATED APPLICATION

This application claims priority from Japanese Patent Application No. 2020-165855 filed on Sep. 30, 2020, the content of which is incorporated herein by reference in its entirety.

BACKGROUND

The present disclosure relates to a printing device and a filter.

A related-art inkjet type printing device includes a head, a carriage, a housing and a filter. The head is mounted on the carriage and accommodated in the housing. The filter is fixed to a lower portion of the carriage, and captures mist floating inside the housing due to reciprocating movement of the carriage.

SUMMARY

In a related-art printing device, when mist accumulates in a filter, mist removal capability decreases. Therefore, the filter needs to be replaced in a given term. At the time of filter replacement, the filter needs to be replaced by being gripped with a hand. Therefore, the filter contaminated by the mist may be directly touched by the hand, and the hand may be contaminated.

An object of the present disclosure is to provide a printing device capable of replacing a filter without directly touching the filter with a hand, and a filter.

A printing device according to an aspect of the present disclosure includes an inkjet head, a filter accommodating portion, a filter configured to be accommodated in the filter accommodating portion and extending in given direction from one end to the other end to collect mist, and a grip portion provided at at least one of the one end or the other end of the filter. The grip portion includes a handle protruding from the filter, a recessed portion recessed inside the filter, or a hole. Therefore, the filter is replaceable by using the grip portion without directly touching the filter with a hand. Accordingly, the mist adhering to the hand at the time of filter replacement is reduced.

A filter according to an aspect of the present disclosure is a filter that is replaceably mounted in a filter accommodating portion of a printing device including an ink jet head and the filter accommodating portion, and collects mist. The filter extends in given direction from one end to the other end, and includes a grip portion provided at at least one of the one end or the other end of the filter. The grip portion includes a handle protruding from the filter, a recessed portion recessed inside the filter, or a hole. Therefore, the filter is replaceable by using the grip portion without directly touching the filter with a hand. Accordingly, the mist adhering to the hand at the time of filter replacement is reduced.

BRIEF DESCRIPTION OF DRAWINGS

FIG. 3A is a front view showing the internal structure of the printing device 1.

FIGS. 3B and 3C are enlarged views of mist collection mechanisms 73 and 74 of FIG. 3A.

DESCRIPTION OF EMBODIMENT

Figure 1:
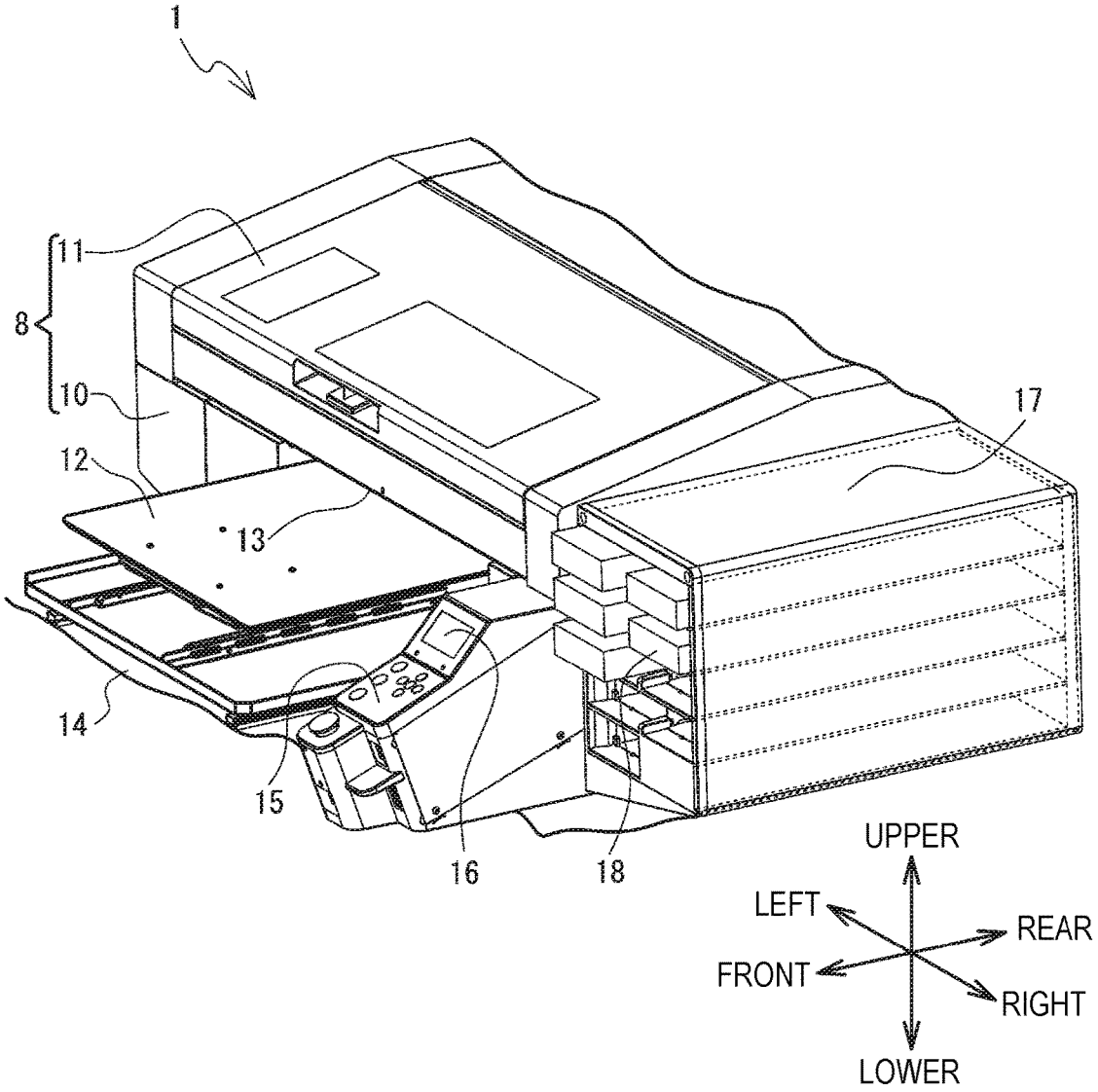
FIG. 1 is a perspective view of a part of a printing device 1.

A printing device 1 according to an embodiment of the present disclosure will be described with reference to the drawings. An upper side, a lower side, a lower left side, an upper right side, a lower right side and an upper left side in FIG. 1 respectively correspond to an upper side, a lower side, a front side, a rear side, a right side and a left side of the printing device 1. An upper-lower direction in FIG. 1 is a vertical direction. In the following description, a left-right direction may be referred to as a main scanning direction, and a front-rear direction may be referred to as a sub-scanning direction. In the present embodiment, mechanical elements in the drawings indicate actual scales.

The printing device 1 shown in FIG. 1 is an inkjet printer, and prints by ejecting ink onto a printing medium such as cloth or paper. The printing device 1 can print a color image on the printing medium using white ink and color ink (ink in four colors of black, yellow, cyan and magenta).

An external configuration of the printing device 1 will be described with reference to FIGS. 1, 2A and 2B. As shown in FIG. 1, the printing device 1 includes a housing 8, a conveyance mechanism 14, an operation button 15, a display screen 16 and a storage unit 17. The housing 8 has a rectangular parallelepiped shape, and includes a main body 10 and a lid 11. In the main body 10, a platen opening 13 having a rectangular shape in a front view is formed at a center of the housing 8 on a sub-scanning direction side, that is, a front surface of the housing 8 in the left-right direction. In the present embodiment, the sub-scanning direction is the front-rear direction. An internal position P described later is located behind the platen opening 13. The lid 11 is provided on an upper side of the main body 10 and can be opened and closed between a position where an upper surface of the main body 10 is covered and a position where the upper surface of the main body 10 is opened by rotating about a rear end of the lid 11. Hereinafter, a space surrounded by the upper surface, a right surface, a bottom surface and a left surface of the housing 8 is referred to as inside of the housing 8.

The operation button 15 and the display screen 16 are provided on a right side of the platen opening 13 on the front surface of the housing 8. The operation button 15 inputs various types of information to the printing device 1 according to an operation by an operator. The display screen 16 displays the various types of information. Therefore, the operator operates the printing device 1 on a front side of the printing device 1.

The conveyance mechanism 14 conveys a platen 12, on which the printing medium is arranged, between the internal position P of the housing 8 and outside of the housing 8 through the platen opening 13. The platen 12 is arranged at the internal position P of the housing 8 shown in FIG. 2A, and a liquid is ejected from a head 30 described later to perform printing.

Figures 2A, 2B:
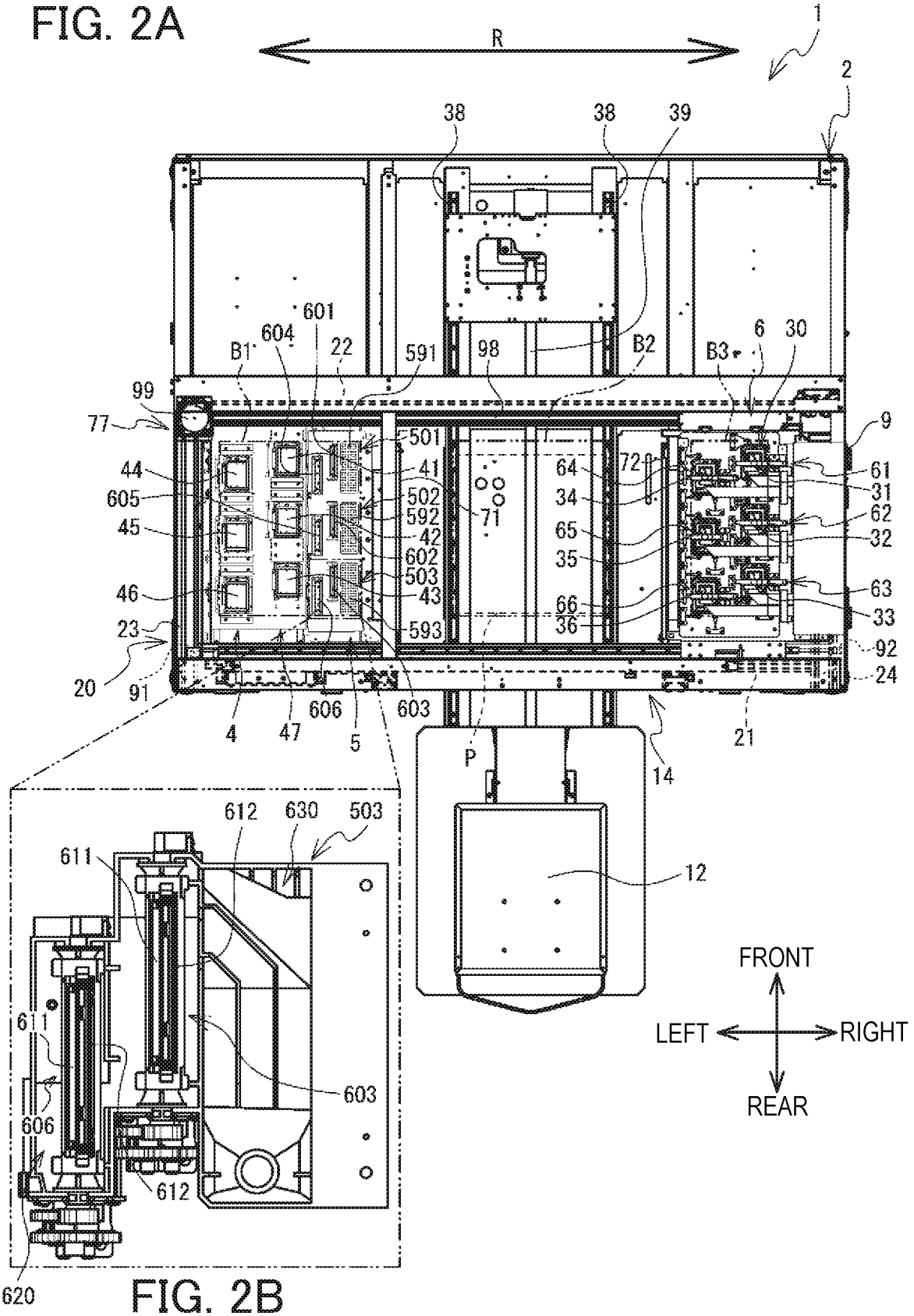
FIG. 2A is a plan view showing an internal structure of the printing device 1.
FIG. 2B is an enlarged view of a cleaning mechanism 503 of FIG. 2A.
Figure 12:
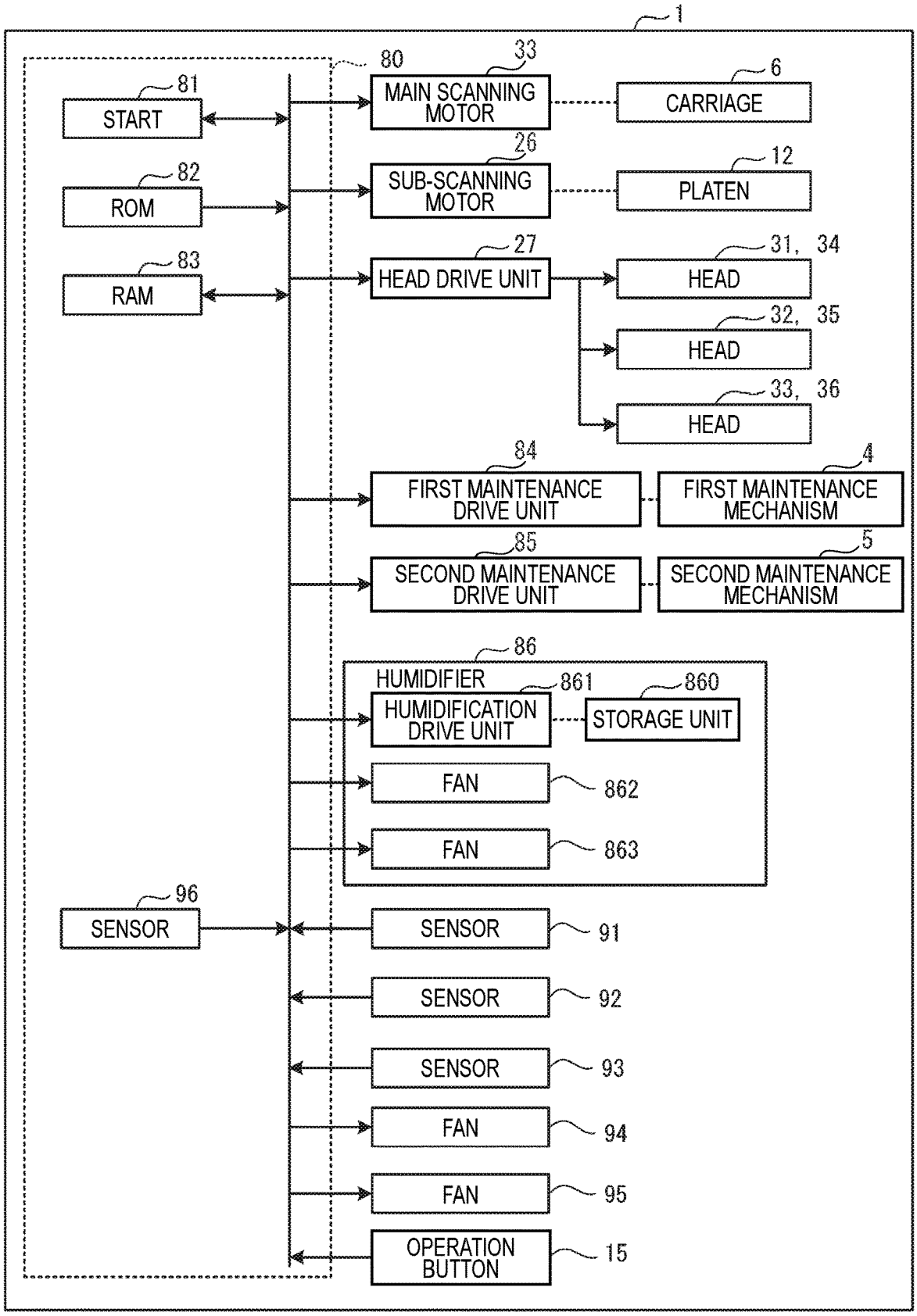
FIG. 12 is a block diagram showing an electrical configuration of the printing device 1.

As shown in FIG. 2A, the conveyance mechanism 14 includes a platen support portion 37 (see FIG. 3A), a pair of left and right rails 38, a transmission member 39 and a sub-scanning motor 26 (see FIG. 12). The platen support portion 37 supports the platen 12 from below. The platen 12 has a plate shape. The pair of left and right rails 38 extend in the front-rear direction and support the platen support portion 37 so as to be movable in the front-rear direction. Front ends of the pair of rails 38 are located forward than the front surface of the housing 8.

The transmission member 39 is connected to the platen support portion 37 and the sub-scanning motor 26, and moves the platen support portion 37 in the front-rear direction along a conveyance path defined by the pair of left and right rails 38 in response to driving of the sub-scanning motor 26.

In a state where the platen 12 is arranged in front of the front surface of the housing 8, that is, outside the housing 8, the operator arranges the printing medium on an upper surface of the platen 12. As shown in FIG. 2A, the storage unit 17 is provided on a right side of the housing 8. A plurality of cartridges 18 are stored in the storage unit 17 from a front side. The cartridges 18 contain various liquids such as ink used for printing.

An internal structure of the printing device 1 will be described with reference to FIGS. 2A to 11. As shown in FIG. 2A, the printing device 1 includes, inside the housing 8 shown in FIG. 1, a frame body 2, inner walls 71, 72 (see FIG. 3A), partition plates 28, 29 (see FIG. 3A), a carriage 6, heads 31 to 36, a substrate box 9, a movement mechanism 77, a first maintenance mechanism 4, a second maintenance mechanism 5, mist collection mechanisms 73, 74 (see FIG. 3A), a humidifier 86 (see FIG. 3A), and sensors 91 to 93 (see FIG. 3A).

As shown in FIG. 3A, the frame body 2 includes a plurality of shafts including shafts 57, 58 and extending in the front-rear direction, a plurality of shafts extending in the left-right direction, and a plurality of shafts including shafts 55, 56 and extending in the upper-lower direction. A guide shaft 20 is fixed to an upper end of the frame body 2. As shown in FIG. 2A, the guide shaft 20 includes a front shaft 21, a rear shaft 22, a left shaft 23 and a right shaft 24.

The front shaft 21 is arranged at a front end portion of the frame body 2, and extends in the left-right direction from a left end portion to a right end portion of the frame body 2. The rear shaft 22 is arranged substantially at a center of the frame body 2 in the front-rear direction, and extends in the left-right direction from the left end portion to the right end portion of the frame body 2. The left shaft 23 is arranged at the left end portion of the frame body 2, and extends in the front-rear direction from a left end of the front shaft 21 to a left end of the rear shaft 22. The right shaft 24 is arranged at the right end portion of the frame body 2, and extends in the front-rear direction from a right end of the front shaft 21 to a right end of the rear shaft 22. The front shaft 21 and the rear shaft 22 support the carriage 6. The conveyance mechanism 14 is fixed to the frame body 2.

As shown in FIG. 3A, the inner walls 71, 72 are arranged to face each other in the main scanning direction intersecting the sub-scanning direction at the internal position P of the housing 8. The inner walls 71, 72 extend in the front-rear direction below the guide shaft 20 and are fixed to the frame body 2. The inner wall 71 is provided on a left side of the platen 12 arranged at the internal position P, and is fixed to the shaft 57. The inner wall 72 is provided on a right side of the platen 12 arranged at the internal position P, and is fixed to the shaft 58. The inner walls 71, 72 are located between the front shaft 21 and the rear shaft 22 in the front-rear direction.

Figure 11:
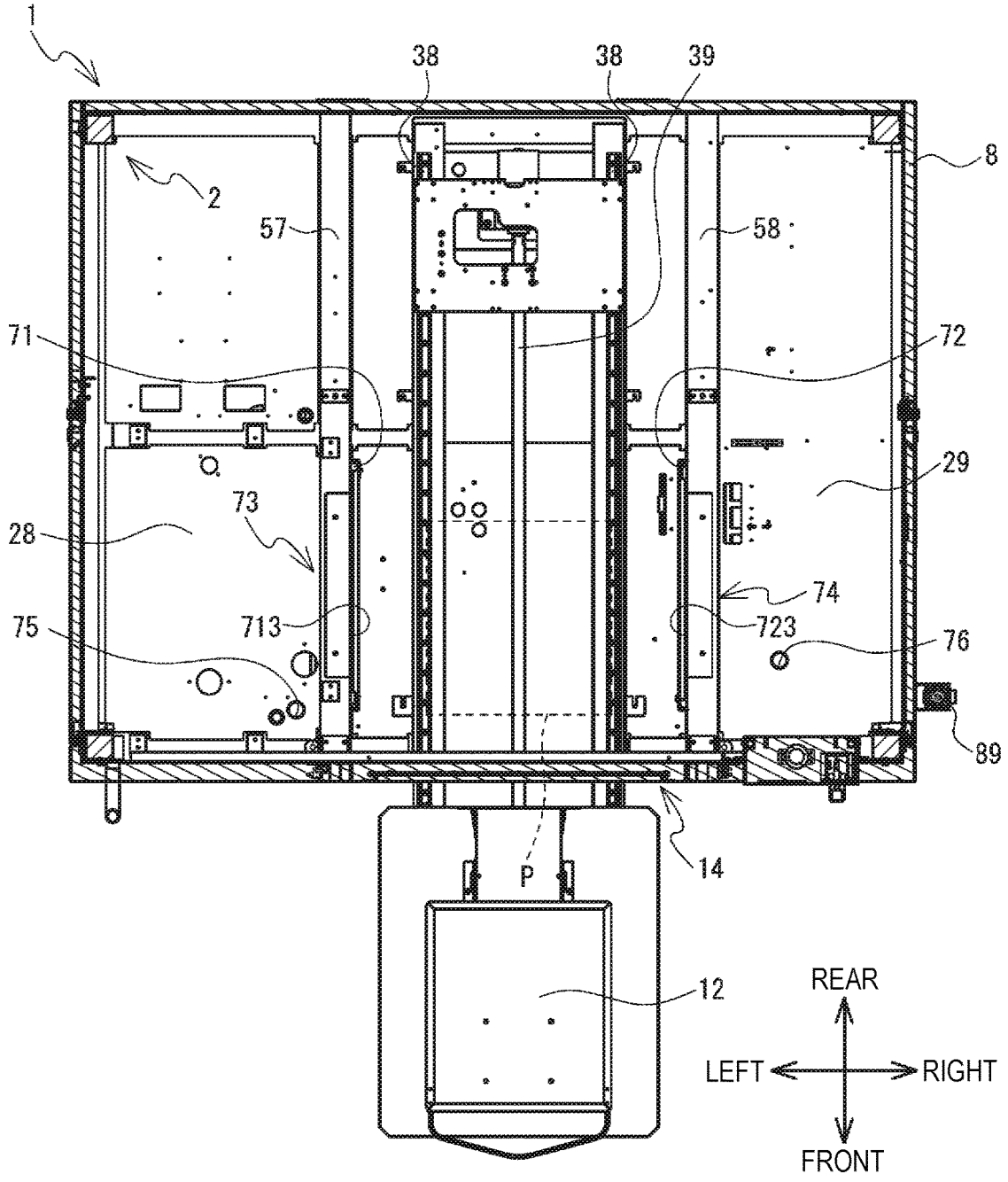
FIG. 11 is a cross-sectional view showing partition plates 28, 29 of the printing device 1 in which a first maintenance mechanism 4 and a second maintenance mechanism 5 are not shown.

The partition plate 28 is fixed to the frame body 2 below the guide shaft 20 and on a left side of the inner wall 71, and extends in the front-rear and left-right directions. A right end portion of the partition plate 28 is connected to a lower end portion of the inner wall 71. The partition plate 29 is fixed to the frame body 2 below the guide shaft 20 and on a right side of the inner wall 72, and extends in the front-rear and left-right directions. A left end portion of the partition plate 29 is connected to a lower end portion of the inner wall 72. As shown in FIG. 11, a supply port 75, which has a circular shape in a plan view and penetrates the partition plate 28 in the upper-lower direction, is formed in a right front portion of the partition plate 28. A supply port 76, which has a circular shape in a plan view and penetrates the partition plate 29 in the upper-lower direction, is formed in a left front portion of the partition plate 29. A positional relationship between the supply port 75 and the supply port 76 is not particularly limited, but in the present embodiment, the supply port 75 is formed in front of the supply port 76 in the front-rear direction.

As shown in FIG. 2A, the carriage 6 is supported by the front shaft 21 and the rear shaft 22 so as to be movable in the main scanning direction. The carriage 6 is provided with mounting portions 61 to 66. The heads 31 to 36 are mounted on the mounting portions 61 to 66, respectively. The mounting portions 61, 62, 63 are arranged at a right portion of the carriage 6, and are arranged in a row from a rear side to a front side in an order of the mounting portions 61, 62, 63. The mounting portions 64, 65, 66 are arranged on a left side of the row of the mounting portions 61, 62, 63, and are arranged in a row from a rear side to a front side in an order of the mounting portions 64, 65, 66.

Each of the heads 31 to 36 is arranged inside the housing 8 and ejects a liquid. Each of white ink and color ink may be ejected from any one of the heads 31 to 36. In the present embodiment, the white ink is supplied to each of the heads 31, 34 from the white ink cartridge 18. A discharge printing agent is supplied to each of the heads 32, 35 from the discharge printing agent cartridge 18. The discharge printing agent is a liquid for discharging a color of the printing medium. The color ink is supplied to each of the heads 33, 36 from the color ink cartridge 18. Each of the heads 31 to 36 ejects the liquid downward when the heads 31 to 36 are at a printing position B2 described later. Hereinafter, when the heads 31 to 36 are collectively referred to, or when any of the heads 31 to 36 is not specified, the heads 31 to 36 are referred to as the head 30.

The movement mechanism 77 moves the carriage 6, on which the head 30 is mounted, in the main scanning direction. The movement mechanism 77 includes a drive belt 98 and a main scanning motor 99. The drive belt 98 is connected to a rear end portion of the carriage 6. The drive belt 98 is provided on the rear shaft 22 and extends in the left-right direction. A left end portion of the drive belt 98 is connected to the main scanning motor 99. When the main scanning motor 99 is driven, the drive belt 98 moves the carriage 6 in the left-right direction along the front shaft 21 and the rear shaft 22.

In FIGS. 2A to 3C, a movement range R of the head 30 is indicated by using a center of the carriage 6 in the left-right direction. As shown in FIG. 3A, the head 30 is mainly arranged at one of three positions including a maintenance position B1, the printing position B2 and a head standby position B3, by the movement mechanism 77. The maintenance position B1 is located at a left end portion of the movement range R of the head 30, and is a position where the head 30 is maintained by the first maintenance mechanism 4 or the second maintenance mechanism 5 described later. The printing device 1 moves the head 30 to the maintenance position B1 when printing is not performed, and performs maintenance by the first maintenance mechanism 4 or the second maintenance mechanism 5. The second maintenance mechanism 5 located on a right side of the first maintenance mechanism 4. The printing position B2 is a position between the maintenance position B1 and the head standby position B3 in the main scanning direction and above the platen 12 arranged at the internal position P. When the head 30 is arranged at the printing position B2, the head 30 ejects the liquid according to print data, and printing is performed on the printing medium placed on the platen 12. The head standby position B3 is located at a right end portion of the movement range R of the head 30, and is a position where the head 30 is arranged when the operator performs an operation such as cleaning on the head 30. For example, the printing device 1 moves the head 30 to the head standby position B3 and causes the head 30 to stand by according to an instruction based on the operation button 15 when printing is not performed.

The first maintenance mechanism 4 is provided at a position facing the head 30 arranged at the maintenance position B1 to maintain the head 30. The first maintenance mechanism 4 is provided on the partition plate 28 on the left side of the inner wall 71 in the housing 8 and below the guide shaft 20. As shown in FIG. 2A, the first maintenance mechanism 4 includes six caps 41 to 46 and a cap support portion 47. A sponge containing a moisturizing liquid is arranged inside each of the caps 41 to 46. A positional relationship of the caps 41 to 46 is the same as a positional relationship of the mounting portions 61 to 66. Each of the caps 41 to 46 has a rectangular shape in a plan view, and is supported from below by the cap support portion 47. The cap support portion 47 can move the caps 41 to 46 in the upper-lower direction. When printing is not performed, the printing device 1 moves the cap support portion 47 upward in a state where the head 30 is located at the maintenance position B1. Thereby, the caps 41 to 46 cover and cap nozzle surfaces of the heads 31 to 36 from below. As a result, drying of the ink or the discharge printing agent in a nozzle provided on the nozzle surface of the head 30 is prevented.

The second maintenance mechanism 5 is provided at a position facing the head 30 arranged at the maintenance position B1 to maintain the head 30. As shown in FIG. 3A, the second maintenance mechanism 5 is provided on the partition plate 28 on the left side of the inner wall 71 in the housing 8 and below the guide shaft 20. The second maintenance mechanism 5 is located between the first maintenance mechanism 4 and the inner wall 71 in the main scanning direction. The second maintenance mechanism 5 is a mechanism that cleans the head 30 by performing wiping and flushing operations on the nozzle surface of the head 30.

As shown in FIG. 2A, the second maintenance mechanism 5 includes cleaning mechanisms 501 to 503. The cleaning mechanisms 501 to 503 are located on a right side of the caps 41 to 43, respectively. The cleaning mechanisms 501 to 503 have the same structure. The cleaning mechanism 501 includes wipers 601, 604 and a punching metal 591. The cleaning mechanism 502 includes wipers 602, 605 and a punching metal 592. FIG. 2B is an enlarged view of the cleaning mechanism 503 of FIG. 2A. As shown in FIG. 2B, the cleaning mechanism 503 includes a wiper 603 and a wiper 606. Each of the cleaning mechanisms 501 to 503 further includes a cleaning liquid tank 620 and a flushing box 630. In FIG. 2B, the punching metal 593 is not shown.

The wipers 601 to 606 wipe the nozzle surfaces of the heads 31 to 36, respectively. Each of the wipers 601 to 606 includes a foam wiper 611 and a rubber wiper 612. The foam wiper 611 is configured to be vertically reversed by a vertical reversing mechanism (not shown) or the like, and to be capable of entering the cleaning liquid tank 620. Therefore, the foam wiper 611 is moistened by a cleaning liquid. The flushing box 630 is provided below each of the punching metals 591 to 593, and receives the liquid that is ejected from the head 30 by a flushing operation and passes through each of the punching metals 591 to 593.

As shown in FIG. 3A, the mist collection mechanisms 73, 74 collect mist generated when the liquid is ejected from the head 30. In the main scanning direction, the mist collection mechanism 73 is provided on a left side of the conveyance mechanism 14 inside the housing 8 (see FIG. 1), and the mist collection mechanism 74 is provided on a right side of the conveyance mechanism 14 inside the housing 8. Since the mist collection mechanisms 73, 74 have configurations symmetrical to each other, the configuration of the mist collection mechanism 73 will be described below, and description of the mist collection mechanism 74 will be omitted.

Figure 4A:
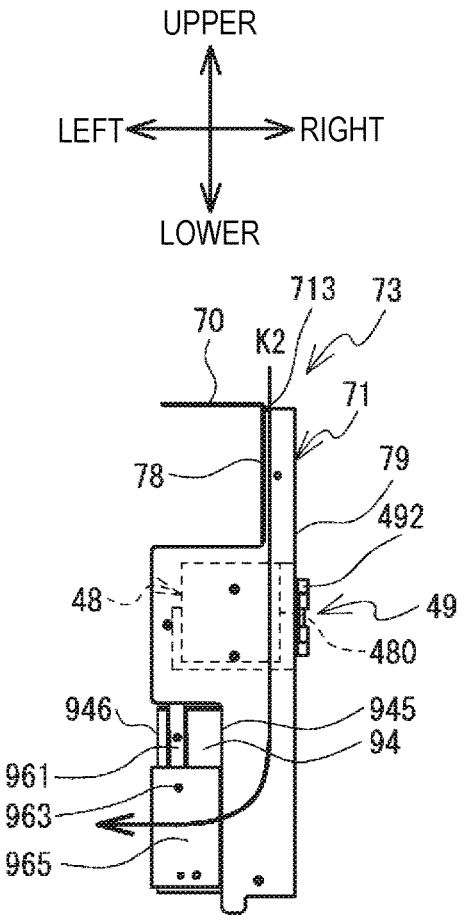
FIGS. 4A and 4B are front views showing opening and closing of an accommodating portion 49 of a mist collection mechanism 73.
Figure 4B:
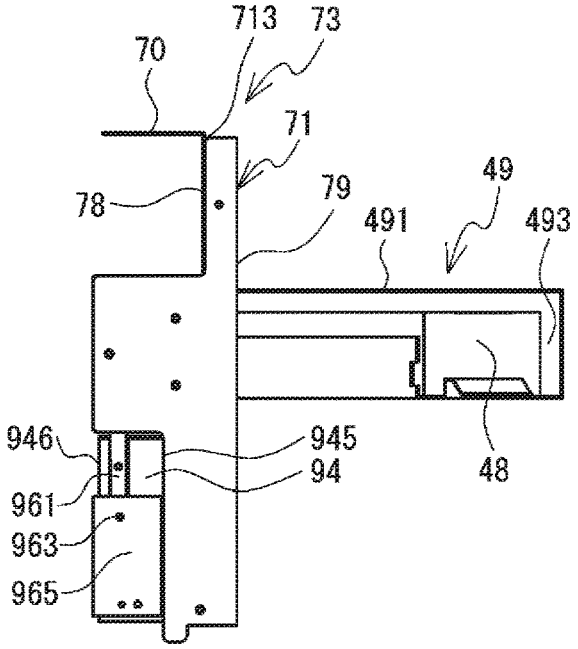
Figure 5A:
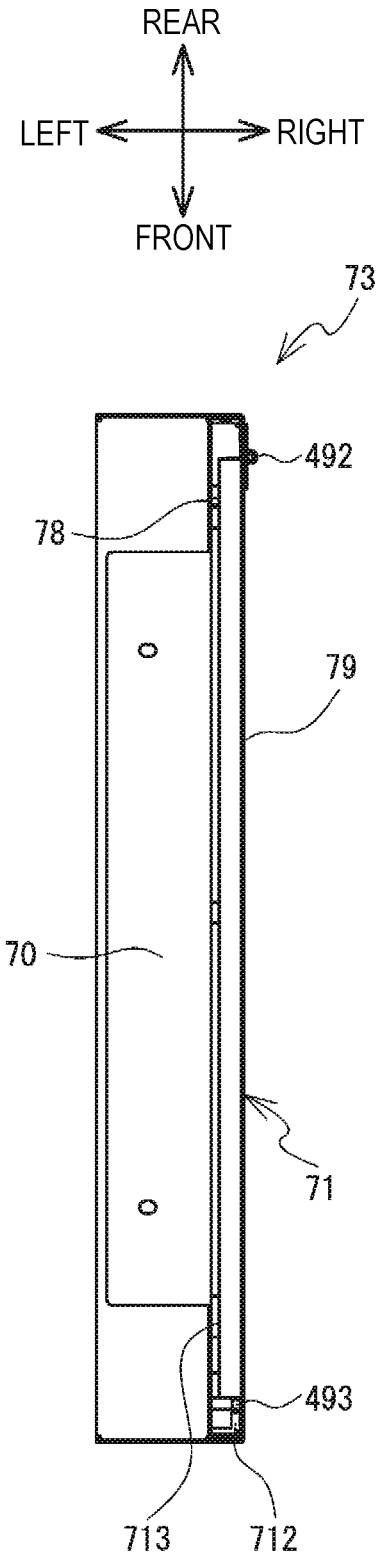
FIGS. 5A and 5B are plan views showing the opening and closing of the accommodating portion 49 of the mist collection mechanism 73.
Figure 5B:
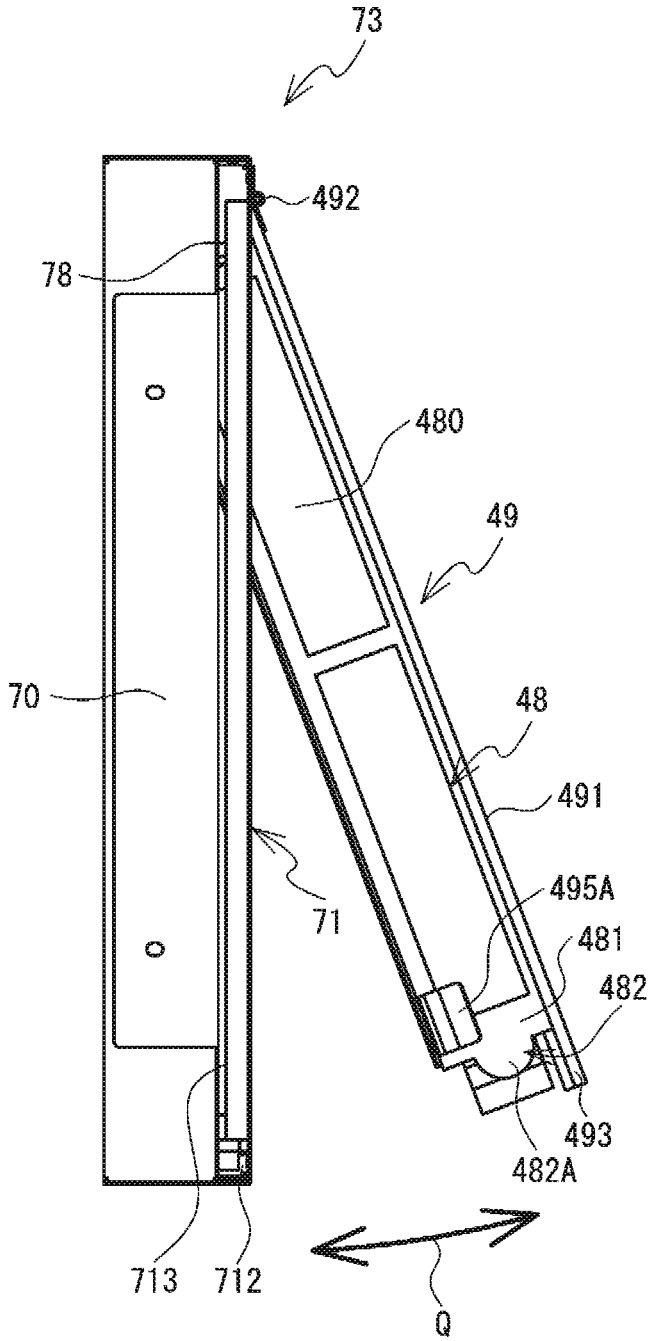
Figure 6:
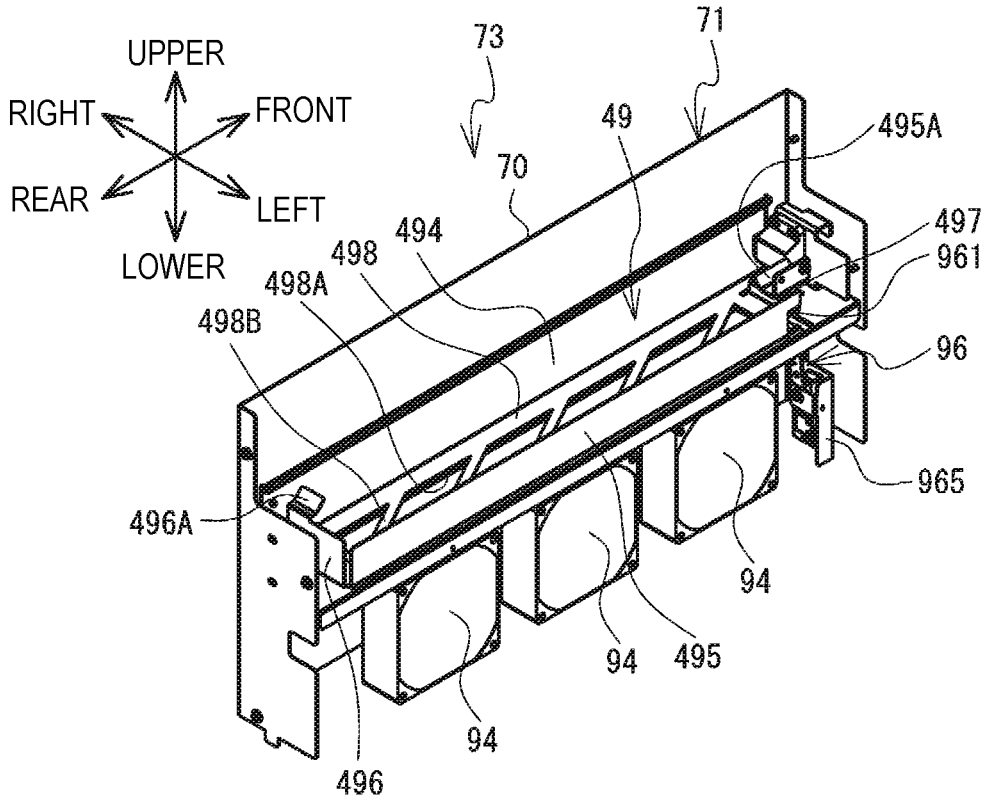
FIG. 6 is a left side view of the mist collection mechanism 73 in which a filter unit 48 is not accommodated in the accommodating portion 49.

As shown in FIGS. 4 to 6, the mist collection mechanism 73 includes the inner wall 71, three fans 94 (see FIG. 6) and a filter unit 48. The inner wall 71 has a hollow box shape. A right surface 79 of the inner wall 71 has a plate shape extending in the upper-lower and front-rear directions. A slit-shaped suction port 713 elongated in the front-rear direction is formed in an upper surface of the inner wall 71.

As shown in FIGS. 4 and 5, the inner wall 71 includes a fixing plate 70 and an accommodating portion 49. The fixing plate 70 is a plate-shaped portion extending in the left-right direction at an upper end of the inner wall 71. As shown in FIG. 3B, the fixing plate 70 is fixed to the shaft 57 extending in the front-rear direction. As shown in FIGS. 4 and 5, the accommodating portion 49 has a box shape, and detachably accommodates the filter unit 48 having a rectangular parallelepiped shape elongated in the front-rear direction inside the inner wall 71. The accommodating portion 49 is provided so as to be openable and closable with respect to the right surface 79 of the inner wall 71 in a direction indicated by an arrow Q (see FIG. 5B) by a hinge 492 connected to a rear end portion of the right surface of the inner wall 71 and a rear end portion of a right surface of a main body 491 of the accommodating portion 49. An engaging portion 493 is provided at a right front portion of the accommodating portion 49, and engages with an engaged portion 712 provided at a front end portion of the right surface 79 of the inner wall 71 so as not to be opened and closed without an operation of the operator.

Structure of Accommodating Portion 49

Figure 7:
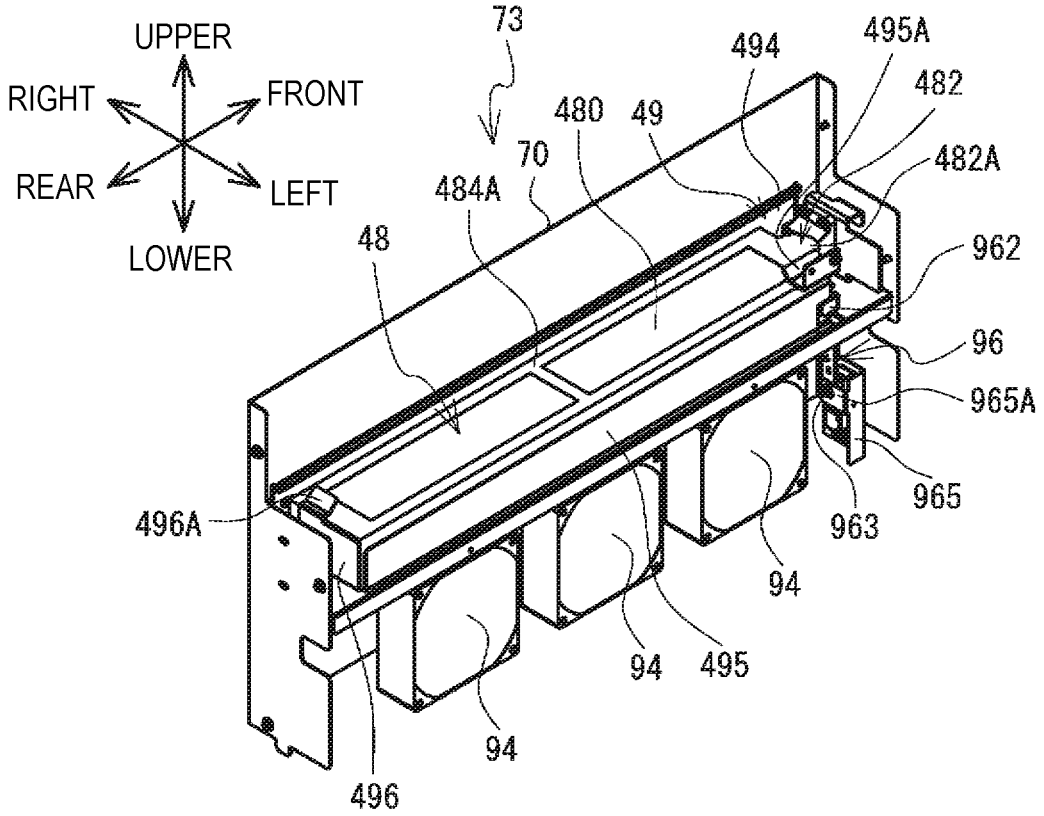
FIG. 7 is a left side view of the mist collection mechanism 73 in which the filter unit 48 is accommodated in the accommodating portion 49.

A structure of the accommodating portion 49 will be described with reference to FIGS. 6 to 8A and 8B. As shown in FIG. 6, the accommodating portion 49 has a box shape whose upper side is open, and extends in the front-rear direction. The accommodating portion 49 includes side walls 494, 495, a rear wall 496 and a front wall 497. The side wall 494 extends in the front-rear direction at a predetermined height along the fixing plate 70. The height of the side wall 494 is, for example, slightly higher than a height of the filter unit 48. The side wall 495 faces and is parallel to the side wall 494, and extends in the front-rear direction at a predetermined height. The height of the side wall 495 is, for example, slightly lower than the height of the filter unit 48. A pressing plate 495A is provided at an upper end portion of a front end portion of the side wall 495. As shown in FIG. 7, the pressing plate 495A extends obliquely upward to the right, and presses a left side of a front end portion of an upper surface 484A of the filter unit 48 downward. The rear wall 496 is provided on a rear end side of the accommodating portion 49, and extends in the left-right direction at a predetermined height. A pressing plate 496A is provided at an upper end portion of the rear wall 496. The pressing plate 496A extends obliquely upward to the front, and presses a rear end portion of the upper surface 484A of the filter unit 48 downward (see FIG. 7).

As shown in FIG. 6, the accommodating portion 49 includes a bottom surface 498. The bottom surface 498 is a bottom plate extending in the front-rear direction. An opening edge portion 498A and an extension portion 498B are provided on the bottom surface 498. The extension portion 498B extends in an oblique direction with respect to the side walls 494, 495, and both ends of the extension portion 498B are connected to the opening edge portion 498A. For example, five extension portions 513 are provided at equal intervals in the opening edge portion 498A. In the present embodiment, the filter unit 48 can be attached to and detached from the accommodating portion 49 from the front side of the printing device 1.

Structure of Sensor 96

Figure 8A:
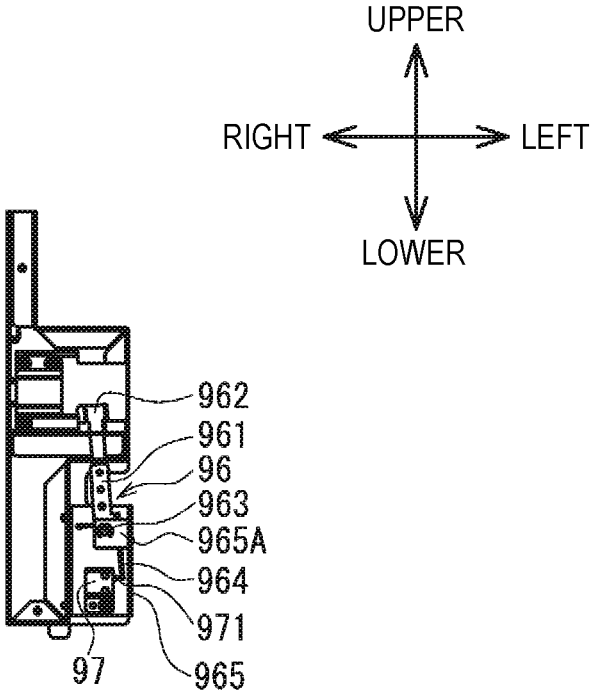
FIGS. 8A and 8B are views showing a structure of a sensor 96.
Figure 8B:
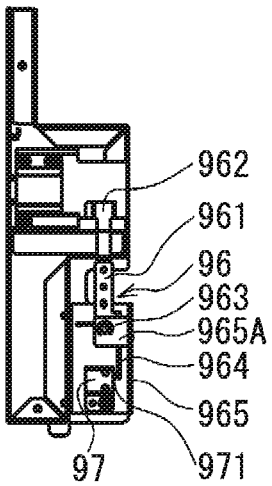

As shown in FIGS. 6 to 8A and 8B, the accommodating portion 49 includes a sensor 96 that detects whether the filter unit 48 is accommodated in the accommodating portion 49. The sensor 96 includes a detection lever 961 and a pressing portion 964. The detection lever 961 is a rod-shaped member extending in the upper-lower direction. The detection lever 961 includes a contact portion 962 at an upper end portion thereof and a shaft support portion (not shown) at a lower end portion thereof, and a pressing portion 964 extends downward from the shaft support portion. A frame 965 is provided at a lower portion of the accommodating portion 49, and a support plate 965A extends from the frame 965 in the left-right direction. The support plate 965A includes a shaft 963 extending in the front-rear direction, and a shaft support portion is rotatably supported by the shaft 963. The pressing portion 964 is also a rod-shaped member. The frame 965 is provided with a physical switch 97. The pressing portion 964 presses an actuator 971 of the physical switch 97. As shown in FIGS. 7 and 8B, when the filter unit 48 is accommodated in the accommodating portion 49, the contact portion 962 physically comes into contact with a filter case 481 of the filter unit 48. As will be described later, since the filter case 481 has rigidity higher than that of the filter 480, the contact portion 962 is more reliably pressed leftward in FIG. 8B. Therefore, the detection lever 961 rotates clockwise about the shaft 963 from a position shown in FIG. 8A to a position shown in FIG. 8B when viewed from a rear side. Therefore, a lower end portion of the pressing portion 964 rotates rightward in FIG. 8B to press the actuator 971 of the physical switch 97. An example of the physical switch 97 is a microswitch. As shown in FIG. 7, the sensor 96 is provided on a front side of the lower portion of the accommodating portion 49. The mist is sent to the fan 94 via an opening formed by the opening edge portion 498A provided in the bottom surface 498 of the accommodating portion 49, and thus the mist is not sent to a position where the sensor 96 is provided. That is, the sensor 96 is provided at the position deviated from a passage of the mist.

As shown in FIGS. 6 and 8A, when the filter unit 48 is not accommodated in the accommodating portion 49, the contact portion 962 does not come into contact with the filter case 481 of the filter unit 48, and thus the contact portion 962 of the detection lever 961 is inclined rightward about the shaft 963. Therefore, the lower end portion of the pressing portion 964 does not press the actuator 971 of the physical switch 97. When only the filter 480 having rigidity lower than that of the filter case 481 is accommodated in the accommodating portion 49, the contact portion 962 may slip into the filter 480. Therefore, as shown in FIG. 8B, the detection lever 961 may not reliably rotate clockwise about the shaft 963, and the lower end portion of the pressing portion 964 may not press the actuator 971 of the physical switch 97. The same applies when the filter case 481 does not have rigidity higher than that of the filter 480. Therefore, the contact portion 962 comes into contact with the filter case 481 of the filter unit 48 to detect presence or absence of the filter unit 48.

As shown in FIGS. 5A and 5B, the accommodating portion 49 is opened and closed by the hinge 492 between an open position and a closed position in the direction indicated by the arrow Q. That is, the accommodating portion 49 is opened and closed in an arc in the left-right direction around the hinge 492. In contrast, as described above, the detection lever 961 also rotates clockwise and counterclockwise, and moves in the left-right direction. Therefore, the detection lever 961 moves along an opening and closing direction of the accommodating portion 49.

Structures of Filter Unit 48 and Filter 480

Figure 9:
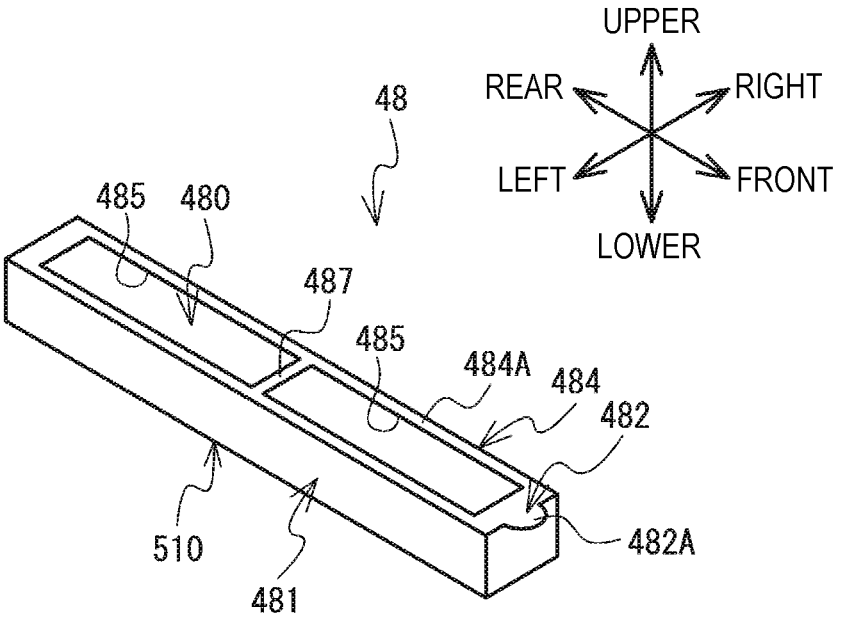
FIG. 9 is a perspective view of the filter unit 48.
Figure 10A:
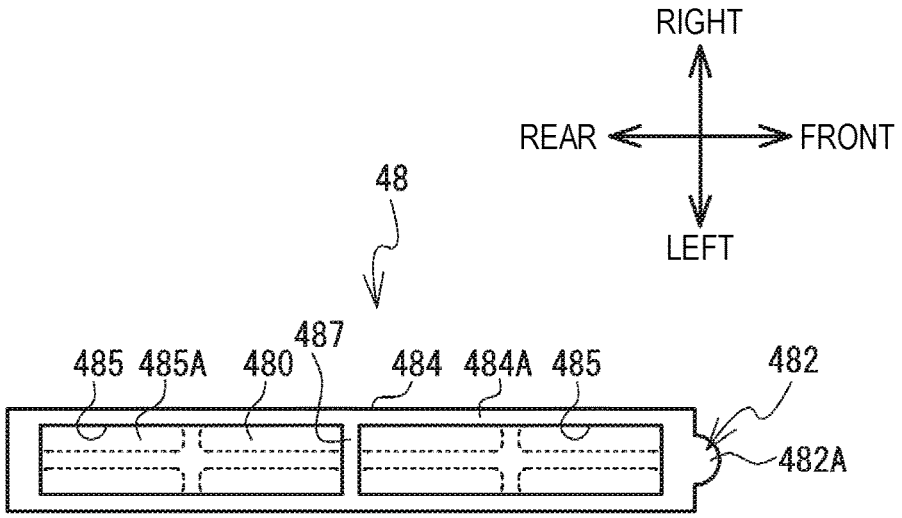
FIG. 10A is a plan view of the filter unit 48.

Structures of the filter unit 48 and the filter 480 will be described with reference to FIGS. 9, 10A and 10B. The filter unit 48 includes the filter 480 and the filter case 481. The filter case 481 is a frame body and supports the filter 480 therein. The filter case 481 has a rectangular parallelepiped shape extending in one direction (forward direction) from one end (rear end) to the other end (front end), and includes an upper case 484 and a lower case 510. The upper case 484 is accommodated in an upper section of the accommodating portion 49, and the lower case 510 is accommodated in a lower section of the accommodating portion 49. As shown in FIG. 10A, the upper case 484 includes the rectangular upper surface 484A extending in the front-rear direction. The upper case 484 includes a grip portion 482 at the other end (front end) of the upper surface 484A. The grip portion 482 is, for example, a handle 482A protruding from the other end (front end) of the upper surface 484A. A protruding direction of the handle 482A is, for example, the one direction (forward direction). The handle 482A is, for example, a semicircular plate. The upper case 484 includes a second opening edge portion 485 and an extension portion 487. The second opening edge portion 485 is a rectangular edge portion elongated in the front-rear direction, and forms an opening 485A. The second opening edge portion 485 is one edge portion to which the extension portion 487 described later is connected. The extension portion 487 extends in the left-right direction, and both ends of the extension portion 487 are connected to the second opening edge portion 485. The extension portion 487 is provided, for example, at a center of the second opening edge portion 485 in the front-rear direction, and has a predetermined width in the front-rear direction. The filter case 481 is more rigid than the filter 480. That is, the filter case 481 has rigidity higher than that of the filter 480. The filter case 481 is made of, for example, a synthetic resin such as polyester or polypropylene, and has rigidity higher than that of fibers constituting the filter 480. Therefore, the filter case 481 is less likely to be deformed than the filter 480.

Figure 10B:
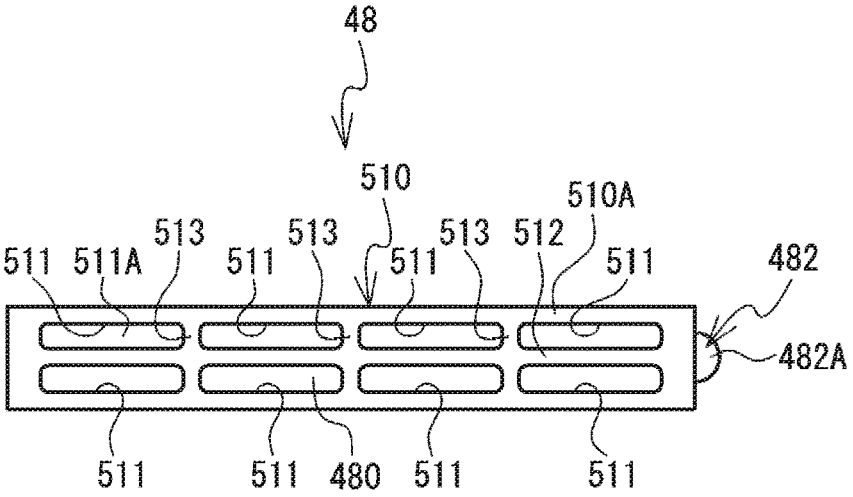
FIG. 10B is a bottom view of the filter unit 48.

As shown in FIG. 10B, the lower case 510 includes a rectangular bottom surface 510A extending in the front-rear direction. The lower case 510 includes a first opening edge portion 511 and extension portions 512, 513. The first opening edge portion 511 is a rectangular edge portion elongated in the front-rear direction, and forms one opening 511A. The first opening edge portion 511 is one edge portion to which extension portions 512 and 513 to described later are connected. The extension portion 512 extends in the front-rear direction, and both ends of the extension portion 512 are connected to the first opening edge portion 511. The extension portion 512 is provided, for example, at a center of the first opening edge portion 511 in the left-right direction, and has a predetermined width in the left-right direction. The extension portion 513 extends in the front-rear direction, and both ends of the extension portion 513 are connected to the first opening edge portion 511. For example, three extension portions 513 are provided in the first opening edge portion 511 at equal intervals. The extension portion 513 has a predetermined width in the front-rear direction.

As an example of dimensions of the filter unit 48 described above, a length in the front-rear direction is 415 mm, a length in the left-right direction is 62 mm, and a height of a side surface is 24 mm. As an example of dimensions of the accommodating portion 49, a length in the front-rear direction is 418 mm and a length in the left-right direction is 64 mm, and heights of the side walls 494, 495, the rear wall 496 and the front wall 497 may be such as to accommodate the filter unit 48. The dimensions of the filter unit 48 and the filter 480 are not limited to the above, and may be any dimensions as long as the accommodating portion 49 can accommodate the filter unit 48. However, it is required that the length in the front-rear direction is the longest, the height of the side surface is the shortest, and the length in the left-right direction is shorter than the length in the front-rear direction and longer than the height of the side surface. An example of dimensions of the handle 482A is a semicircular shape having a radius R of 13 mm. The filter 480 preferably has a large volume, and preferably has a rectangular parallelepiped shape so as to retain the mist as much as possible. For example, when several filters are laid in the accommodating portion 49, a volume of the filter may not be large and the mist may not be sufficiently retained. In the filter unit 48, at least an upper surface or a bottom surface of the filter 480 need to be exposed from the openings 485A, 511A, respectively, since it is necessary to take in air containing the mist from above and send out the air from which the mist has been collected downward, as shown in FIGS. 10A and 10B.

The filter 480 adsorbs and collects the mist in the air. The filter 480 is, for example, a resin filter in which a plurality of minute holes are formed, and the mist is adsorbed on a surface of the filter 480. The filter 480 is formed by, for example, overlapping two layers of filters made of the same material. The filter 480 has a rectangular parallelepiped shape extending in the one direction (front-rear direction) from the one end (rear end) to the other end (front end). In general, since a filter having only small holes has high mist collection performance, the holes are more likely to be clogged with the mist and the collection performance decreases in a relatively short time, compared to a filter having large holes. In contrast, in the filter 480, it is desirable that an average size of minute holes of the filter 480 becomes smaller toward a downstream side of a flow of the air taken into the inner wall 71 from the suction port 713 by driving of the fan 94. Thereby, a time for which collection performance of the filter 480 decreases is prolonged while increasing a collection rate of the mist by the filter 480.

The three fans 94 shown in FIG. 6 are arranged inside the housing 8 (see FIG. 1). The three fans 94 are arranged at a liquid ejection direction side (that is, downward) from the head 30. For example, the fan 94 may be arranged below the front shaft 21 and the rear shaft 22. The three fans 94 are provided at a lower portion of a left surface 78 of the inner wall 71. The three fans 94 are arranged at substantially equal intervals in the front-rear direction, and have the following configuration. As shown in FIG. 3B, a suction port 945 of the fan 94 is located on a right side of the fan 94, and an exhaust port 946 of the fan 94 is located on a left side of the fan 94. That is, the suction port 945 is located on a side of the platen 12 arranged at the internal position P with respect to the fan 94, and the exhaust port 946 is located on a left surface side of the housing 8 and on a side of the first maintenance mechanism 4 and the second maintenance mechanism 5 with respect to the fan 94. Therefore, the exhaust port 946 of the fan 94 is located inside the housing 8. The fan 94 is arranged between the inner wall 71 and the supply port 75 in the main scanning direction. The suction port 945 of the fan 94 is connected to the lower portion of the left surface 78 of the inner wall 71.

The filter 480 is arranged on a side of the fan 94 with respect to the supply port 75. For example, the filter 480 may be located in a path in the housing 8 from the exhaust port 946 of the fan 94 toward the supply port 75, and more preferably, the filter 480 is arranged in a path in the housing 8 from the head 30 toward the suction port 945 of the fan 94.

The suction port 713 is closer to a mist generation source, that is, the head 30 at the printing position B2 than the suction port 945 of the fan 94. As shown in FIGS. 4A and 4B, in the mist collection mechanism 73, when each fan 94 is driven, the air sucked into the inner wall 71 from the suction port 713 of the inner wall 71 passes through the filter unit 48, so that the filter 480 adsorbs and collects the mist in the air. The air that has passed through the filter 480 and from which the mist has been collected is discharged from a space inside the inner wall 71 from the suction port 945 of the fan 94 via the exhaust port 946. That is, when the fan 94 is driven, the air flows in a space surrounded by the right surface 79 and the left surface 78 of the inner wall 71 as indicated by an arrow K2.

When the number of printed sheets in the printing device 1 reaches a predetermined number, a display prompting replacement of the filter 480 is displayed on the display screen 16. In the mist collection mechanism 73, when the filter 480 is replaced, the operator operates the engaging portion 493 in a state where the platen 12 is moved to the back of the housing 8. Thereby, engagement with the engaged portion 712 (see FIG. 5B) is released, and the accommodating portion 49 rotates about the hinge 492. The operator grips the grip portion 482 of the filter case 481 from a front surface side of the printing device 1, removes the used filter 480 together with the filter case 481, fits the filter case 481 having the built-in unused filter 480 into the accommodating portion 49, and then operates the engaging portion 493. Thereby, the accommodating portion 49 rotates about the hinge 492, and as shown in FIGS. 4A and 5A, the engaging portion 493 engages with the engaged portion 712, and the main body 491 is accommodated in the inner wall 71.

As shown in FIG. 3C, the mist collection mechanism 74 includes the inner wall 72, three fans 95 (only one of which is shown in FIG. 3C) and the filter unit 48, corresponding to the inner wall 71, the three fans 94 and the filter unit 48 of the mist collection mechanism 73, respectively. A slit-shaped suction port 723 elongated in the front-rear direction (see FIG. 11) and corresponding to the suction port 713 is formed in an upper surface of the mist collection mechanism 74. When each fan 95 is driven, the air flows through a space inside the inner wall 72 as indicated by an arrow K12 (see FIG. 13). Specifically, when each fan 95 is driven, the air sucked from the suction port 723 passes through the filter 480 of the filter unit 48, and then is sent from a side of a suction port 955 of the fan 95 to a side of an exhaust port 956 of the fan 95.

The humidifier 86 shown in FIG. 3A supplies humidified air to the supply port 75 arranged on a side of the exhaust port 946 of the fan 94 (a left side of the fan 94). The humidifier 86 supplies the humidified air to the supply port 76 arranged on the side of the exhaust port 956 of the fan 95 (a right side of the fan 95). A position where the humidifier 86 is arranged is not particularly limited, but the humidifier 86 is provided inside the housing 8 and below the partition plate 29. The humidifier 86 includes a storage unit 860 (see FIG. 12), a humidification drive unit 861 (see FIG. 12), a suction port 89, tubes 87, 88, and fans 862, 863 (see FIG. 12). The storage unit 860 stores a liquid (for example, water) used for humidification. A water supply pipe may be connected to the storage unit 860, and, for example, water may be supplied to the storage unit 860 from a water tap or an external device such as a water supply tank (not shown).

The suction port 89 is attached to a right side surface of the housing 8, and takes the air into the humidifier 86 from the outside of the housing 8. The humidification drive unit 861 humidifies the air taken into the humidifier 86 from the outside of the housing 8 via the suction port 89 using the liquid stored in the storage unit 860. The humidification drive unit 861 may humidify the air by any method such as a steam method, a vaporization method, an ultrasonic method and an electrolysis method. The humidifier 86 may include a filter that removes dust and the like in the air in a flow path of the air before humidification, such as between the suction port 89 and the storage unit 860 (see FIG. 12). One end of the tube 87 is connected to the humidifier 86, and the other end thereof is connected to the supply port 75. The supply port 75 is located below the head 30 arranged on a left end side of the movement range R. One end of the tube 88 is connected to the humidifier 86, and the other end thereof is connected to the supply port 76. The supply port 76 is located below the head 30 arranged on a right end side of the movement range R.

The fan 862 shown in FIG. 12 supplies the air humidified by the humidification drive unit 861 to the supply port 75 via the tube 87 shown in FIG. 3A. The humidified air supplied to the supply port 75 is sent toward the head 30 through a space (left side space) on the left side of the inner wall 71 inside the housing 8 and above the partition plate 28. The fan 863 shown in FIG. 12 supplies the air humidified by the humidification drive unit 861 to the supply port 76 via the tube 88 shown in FIG. 3A. The humidified air supplied from the supply port 76 is sent toward the head 30 inside the housing 8 through a space (right side space) on the right side of the inner wall 72 inside the housing 8 and above the partition plate 29. In the printing device 1, since an internal space thereof is partitioned into upper and lower spaces by the partition plates 28, 29, the humidified air supplied to the supply ports 75, 76 by the humidifier 86 is easily directed to the head 30.

Electrical Configuration of Printing Device 1

An electrical configuration of the printing device 1 will be described with reference to FIG. 12. As shown in FIG. 12, a controller 80 of the printing device 1 includes a CPU 81, a ROM 82 and a RAM 83. The CPU 81 is electrically connected to the ROM 82 and the RAM 83, and controls the printing device 1. The ROM 82 stores a control program for the CPU 81 to control an operation of the printing device 1, information required by the CPU 81 when various programs are executed, and the like. The RAM 83 temporarily stores various types of data used in the control program, print data for printing on the printing medium, and the like. Some of these electrical elements are provided in the substrate box 9 provided on a right side of the head 30.

The main scanning motor 99, the sub-scanning motor 26, a head drive unit 27, a first maintenance drive unit 84, a second maintenance drive unit 85, the humidifier 86, the sensors 91 to 93, 96, the fans 94, 95 and the operation button 15 are electrically connected to the CPU 81. The main scanning motor 99 is driven to move the carriage 6 in the main scanning direction. The sub-scanning motor 26 is driven to move the platen 12 in the sub-scanning direction. Thereby, the head 30 (see FIG. 2B) moves relative to the platen 12 in the main scanning direction and the sub-scanning direction. The head drive unit 27 is configured by a pressure element or the like, and is driven to eject the white ink from the heads 31, 34, eject the discharge printing agent from the heads 32, 35, or eject the color ink from the heads 33, 36.

The first maintenance drive unit 84 can move the cap support portion 47 (see FIG. 2B) in the upper-lower direction. The second maintenance drive unit 85 can change positions of the wipers 601 to 606 (see FIG. 2B) between a contact position and a non-contact position. Each of the sensors 91 to 93 detects a temperature and a humidity inside the housing 8, and outputs a detection result to the CPU 81. The CPU 81 can determine whether the detection result satisfies a predetermined ejection standard based on the detection result from each of the sensors 91 to 93. The operation button 15 is operated by the operator and outputs a signal corresponding to the operation to the CPU 81. The operator can input, for example, a printing instruction for starting printing to the printing device 1 by operating the operation button 15.

As shown in FIG. 3A, each of the sensors 91 to 93 is provided inside the housing 8 and detects both the temperature and the humidity inside the housing 8. The sensors 91, 92 are provided corresponding to the supply ports 75, 76, respectively. For example, as shown in FIGS. 2A to 3C, the sensor 91 is arranged on a left side of the front shaft 21 and in vicinity of an upper side of the supply port 75, and the sensor 92 is arranged on a right side of the front shaft 21 and in vicinity of an upper side of the supply port 76. As shown in FIG. 3A, the sensor 93 is arranged below the partition plate 29 and on a left side of the humidifier 86, and detects a temperature and a humidity of atmosphere around the humidifier 86, that is, non-humidified atmosphere not humidified by the humidifier 86. The sensor 96 is provided in the accommodating portion 49 and detects whether the filter unit 48 is accommodated in the accommodating portion 49.

According to the above configuration, the printing device 1 conveys the printing medium in the front-rear direction and the left-right direction with respect to the head 30 by moving the platen 12 in the front-rear direction (the sub-scanning direction) by driving the sub-scanning motor 26 and moving the carriage 6 in the left-right direction (the main scanning direction) by driving the main scanning motor 99. The printing device 1 ejects various types of liquid from the head 30 while conveying the printing medium in the front-rear direction and the left-right direction with respect to the head 30. Specifically, the printing device 1 first ejects the discharge printing agent from the heads 32, 35 to discharge the color from the printing medium. Alternatively, the printing device 1 first forms a base on the printing medium by ejecting the white ink from the heads 31, 34. The printing device 1 prints a color image by ejecting the color ink from the heads 33, 36 onto a portion of the printing medium from which the color is discharged or the formed base. The printing device 1 may eject both the white ink and the discharge printing agent.

Figure 13:
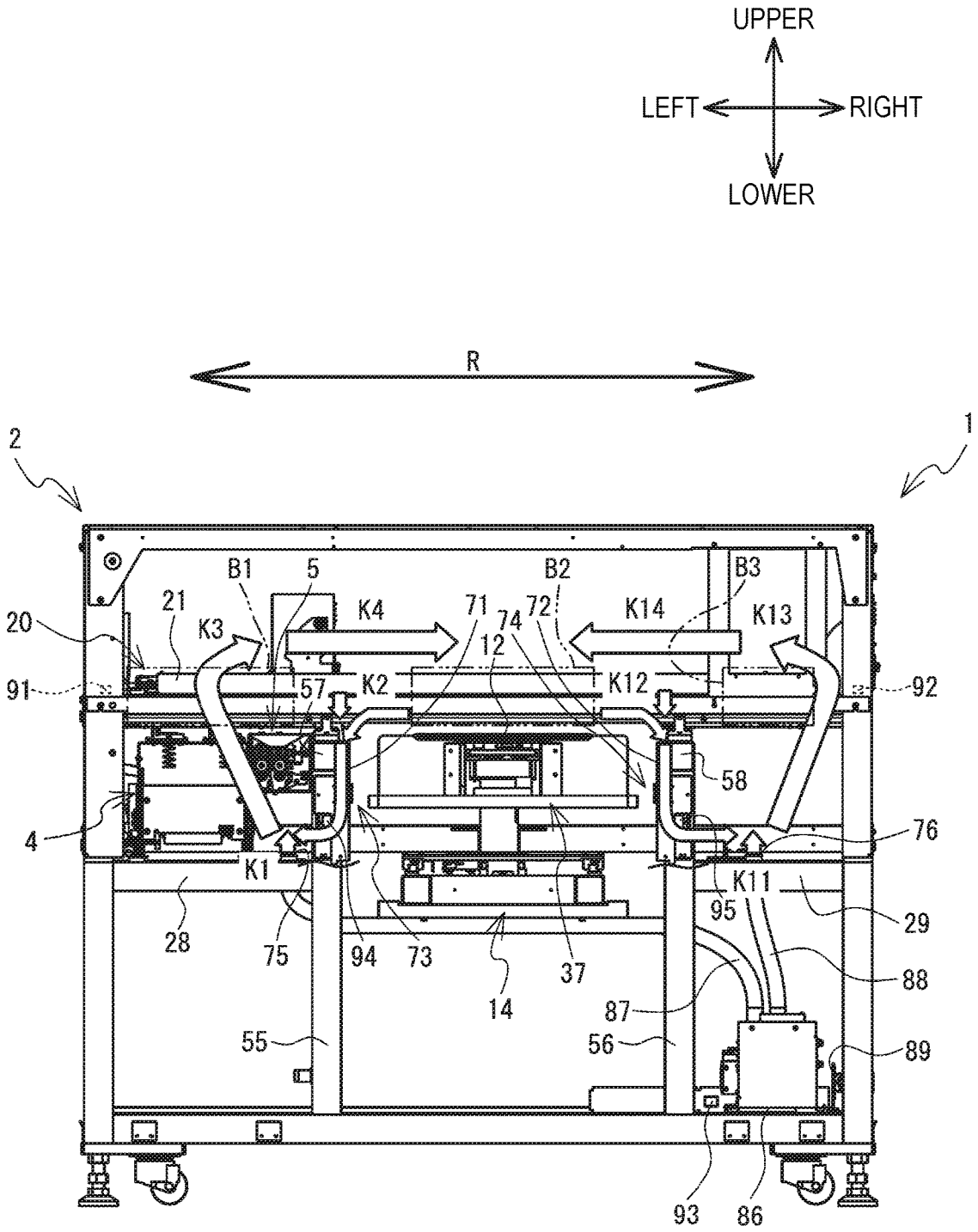
FIG. 13 is an explanatory view of a flow of air inside the printing device 1 when fans 94, 95, 862, 863 are driven.

A flow of air inside the housing 8 when the CPU 81 of the printing device 1 drives the fans 94, 95 and the humidifier 86 (see FIG. 1) will be described with reference to FIG. 13. When the CPU 81 drives the fans 94, 95 and the humidifier 86, the humidified air flowing from the humidifier 86 toward the supply port 75, which is indicated by an arrow K1, and the air discharged from the exhaust port 946 of the fan 94 (see FIG. 3B), which is indicated by an arrow K2, merge with each other on the left side of the inner wall 71 inside the housing 8. The humidified air merged with the air discharged from the exhaust port 946 moves leftward and upward in a left side space between the left surface of the housing 8 and the inner wall 71 as indicated by an arrow K3.

The humidified air moves rightward along the upper surface of the housing 8 above the guide shaft 20 as indicated by an arrow K4. A part of the humidified air is sucked into the inner wall 71 from the suction port 713 (see FIG. 3B), and the rest of the humidified air is discharged to the outside of the housing 8 from the platen opening 13 (see FIG. 1). That is, the humidified air supplied from the supply port 75 merges with the air discharged from the exhaust port 946 of the fan 94 (see FIG. 3B), and moves as indicated by the arrows K3, K4, whereby the nozzle surfaces of the heads 31 to 36 shown in FIG. 2B are humidified, and drying of the liquid inside the nozzle provided in the head 30 is prevented. It is also possible to prevent drying of the foam wiper 611 moistened by the sponge containing the moisturizing liquid arranged inside each of the caps 41 to 46 of the first maintenance mechanism 4 and the cleaning liquid of the second maintenance mechanism 5.

Similarly, in a right side space on the right side of the inner wall 72 inside the housing 8, air flows indicated by arrows K11 to K13 respectively corresponding to the arrows K1 to K3 are generated. The humidified air moves leftward along the upper surface of the housing 8 above the guide shaft 20 as indicated by an arrow K14. A part of the humidified air is sucked from the suction port 723 (see FIG. 11), and the rest of the humidified air is discharged to the outside of the housing 8 from the platen opening 13. The humidified air supplied from the supply port 76 merges with the air discharged from the exhaust port 956 of the fan 95 (see FIG. 3C), and moves as indicated by the arrows K13, K14, thereby humidifying atmosphere in vicinity of the right end portion of the movement range R of the head 30 and the nozzle surfaces of the heads 31 to 36.

Platen movement processing will be described with reference to FIGS. 1, 12 and 14. The CPU 81 operates by reading the control program from the ROM 82 to execute the platen movement processing. First, the CPU 81 determines whether the platen is moved (S1). For example, when the operation button 15 is operated by the operator and an instruction such as a printing instruction for moving the platen is input, it is determined that the platen is moved (S1: YES). The CPU 81 also determines that the platen is moved when the printing instruction is input from the operation button 15 or a terminal device (not shown) (S1: YES).

Next, the CPU 81 determines whether the filter 480 is accommodated in the accommodating portion 49 (S2). As shown in FIGS. 7 and 8B, when the filter unit 48 is accommodated in the accommodating portion 49, the contact portion 962 of the detection lever 961 physically comes into contact with the filter case 481, so that the detection lever 961 rotates leftward about the axis 963 and becomes vertical. Therefore, the lower end portion of the pressing portion 964 rotates rightward and presses the actuator 971 of the physical switch 97. Accordingly, the physical switch 97 is turned on, and it is detected that the filter unit 48 is accommodated in the accommodating portion 49 (S2: YES). Next, the CPU 81 drives the sub-scanning motor 26 to move the platen support portion 37 in the front-rear direction along the conveyance path defined by the pair of left and right rails 38 (S3).

When it is determined in S1 that the platen is not moved (S1: NO), the CPU 81 repeats the processing of S1. When it is determined in S2 that the filter unit 48 is not accommodated in the accommodating portion 49 (S2: NO), the CPU 81 repeats the processing of S2. As shown in FIG. 5B, when the accommodating portion 49 is opened, even if the filter 480 is accommodated in the accommodating portion 49 as shown in FIG. 7, the filter case 481 does not come into contact with the contact portion 962, and the detection lever 961 does not rotate clockwise about the shaft 963 as shown in FIG. 8B. Therefore, the lower end portion of the pressing portion 964 does not rotate rightward as shown in FIG. 8B, and does not press the actuator 971 of the physical switch 97. Accordingly, the physical switch 97 is not turned on. Therefore, even when the filter 480 is accommodated in the accommodating portion 49, the sensor 96 can detect that the accommodating portion 49 is opened.

When the accommodating portion 49 is closed as shown in FIG. 5A and the filter 480 is accommodated in the accommodating portion 49 as shown in FIG. 7, the filter unit 48 is pressed leftward by the fixing plate 70 and the side wall 494 shown in FIG. 7. Therefore, the filter case 481 comes into contact with the contact portion 962, and the detection lever 961 rotates leftward about the shaft 963 and becomes vertical. Accordingly, the lower end portion of the pressing portion 964 rotates rightward and presses the actuator 971 of the physical switch 97. Therefore, the physical switch 97 is turned on. Accordingly, when the filter 480 is accommodated in the accommodating portion 49, the sensor 96 can detect that the accommodating portion 49 is closed.

Effects of Embodiment

In the present embodiment, since the filter 480 includes the grip portion 482 provided on a front end side, the filter 480 is replaceable by using the grip portion 482 without directly touching the filter 480 with a hand. Accordingly, the mist adhering to the hand at the time of filter replacement is reduced.

Since the filter 480 includes the handle 482A as the grip portion 482 protruding forward from a front end of the filter case 481, the handle 482A is less likely to be contaminated, and the mist adhering to the hand at the time of filter replacement is reduced.

Since the grip portion 482 is provided in the filter case 481, a possibility of touching the filter 480 is reduced, and the mist adhering to the hand at the time of filter replacement is reduced.

Since the filter case 481 has rigidity higher than that of the filter 480, the filter case 481 is less likely to be deformed than the filter 480 alone. Therefore, an original shape of the filter 480 is easily maintained, a possibility that the filter 480 accidentally comes into contact with the operator is reduced, and the mist adhering to the hand at the time of filter replacement is reduced.

Since the grip portion 482 is provided on the upper case 484 accommodated in an upper section of the accommodating portion 49, the grip portion 482 is located on an upper side and is easily gripped. When the grip portion 482 is provided in the lower case 510, the mist moving from the upper side to a lower side inside the filter 480 easily adheres to the grip portion. Therefore, when the grip portion 482 is provided on the upper case 484, the mist moves from the upper side to the lower side inside the filter 480, and thus, when the grip portion 482 is located in the upper case 484, the grip portion 482 is less likely to be contaminated than when the grip portion 482 is located in the lower case 510, and the mist adhering to the hand at the time of filter replacement is reduced.

As shown in FIG. 10B, since the lower case 510 includes the extension portions 513 extending to be connected to the first opening edge portion 511 at both ends, rigidity of the lower case 510 is increased. Since the extension portion 513 extends in the front-rear direction, even if the filter unit 48 is moved in the front-rear direction when the filter unit 48 is attached to or detached from the accommodating portion 49, a possibility that the extension portion 513 is caught by the bottom surface 498 of the accommodating portion 49 is reduced.

As shown in FIG. 10A, since the upper case 484 includes the extension portion 487 extending to be connected to the second opening edge portion 485 at both ends, rigidity of the upper case 484 is increased.

As shown in FIGS. 10A and 10B, the extension portion 513 extends in the left-right direction intersecting the front-rear direction, and the extension portion 487 extends in the left-right direction intersecting the front-rear direction, so that rigidity of the lower case 510 and the upper case 484 is increased.

As shown in FIG. 7, since the sensor 96 is provided in the accommodating portion 49 and detects whether the filter 480 is accommodated in the accommodating portion 49, the sensor 96 can detect whether the filter 480 is accommodated in the accommodating portion 49.

Figure 14:
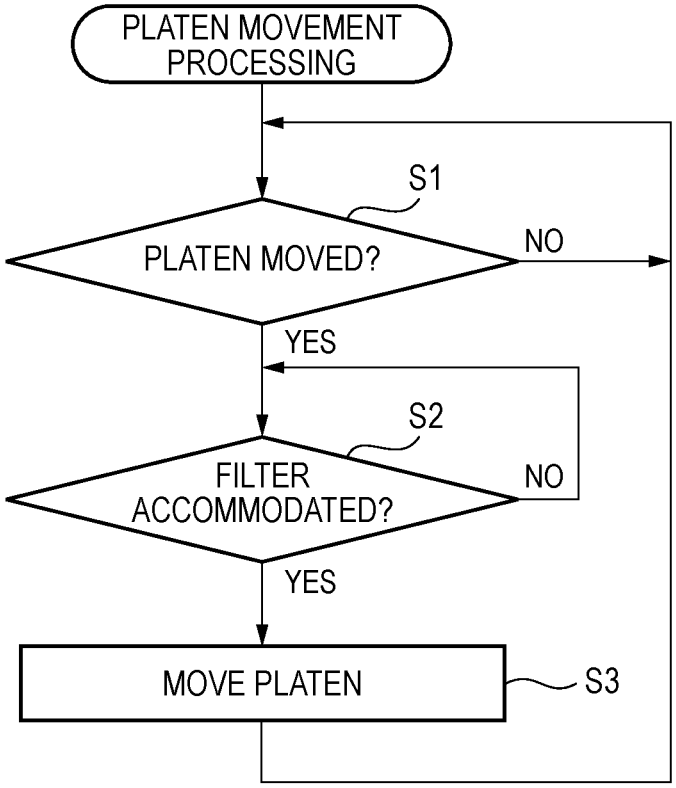
FIG. 14 is a flowchart of platen movement processing.

As shown in FIG. 14, when the sensor 96 detects that the filter 480 is accommodated in the accommodating portion 49, the CPU 81 moves the platen 12, so that the platen 12 can be prevented from moving without the filter 480.

As shown in FIG. 7, the sensor 96 includes the detection lever 961 provided at a position where the detection lever 961 can come into contact with the filter 480 accommodated in the accommodating portion 49. Therefore, in a non-contact type sensor such as an optical sensor, there is a possibility of erroneous detection due to the mist. On the other hand, in the present embodiment, the detection lever 961 comes into contact with the filter case 481 of the filter 480, and the sensor 96 detects whether the filter 480 is accommodated in the accommodating portion 49. Therefore, the possibility of erroneous detection is reduced. In the present embodiment, since the sensor 96 is arranged outside a passage of the mist, the possibility of erroneous detection due to the mist is reduced. Since a position of the detection lever 961 is on a side opposite to the hinge 492 serving as a rotation center of the filter unit 48, a movement region of the detection lever 961 may be widened and erroneous detection is reduced.

As shown in FIG. 7, since the detection lever 961 physically comes into contact with the filter case 481 having rigidity higher than that of the filter 480, erroneous detection is reduced.

The accommodating portion 49 of the filter 480 is opened and closed between the open position and the closed position, and the detection lever 961 moves along the opening and closing direction of the accommodating portion 49. Therefore, since the detection lever 961 moves in accordance with movement of the accommodating portion 49 between the open position and the closed position, it is easy to detect presence or absence of the filter at the closed position more accurately.

Since the sensor 96 also detects the open position or the closed position of the accommodating portion 49, the sensor 96 can more accurately detect that the filter is accommodated in the filter accommodating portion when the filter accommodating portion is at the closed position.

As shown in FIG. 14, the CPU 81 that moves the platen 12 moves the platen 12 when the sensor 96 detects that the accommodating portion 49 of the filter 480 is at the closed position and the filter 480 is accommodated in the accommodating portion 49. Therefore, it is possible to reduce a possibility that the platen 12 moves when the accommodating portion 49 is at the open position and the accommodating portion 49 becomes an obstacle to movement of the platen 12. It is possible to reduce a possibility that the platen 12 moves in a state where the filter 480 is not accommodated in the accommodating portion 49.

Since the filter 480 can be attached to and detached from the accommodating portion 49 from the front surface side of the printing device 1, the filter 480 can be easily attached to and detached from the accommodating portion 49.

Figure 15A:
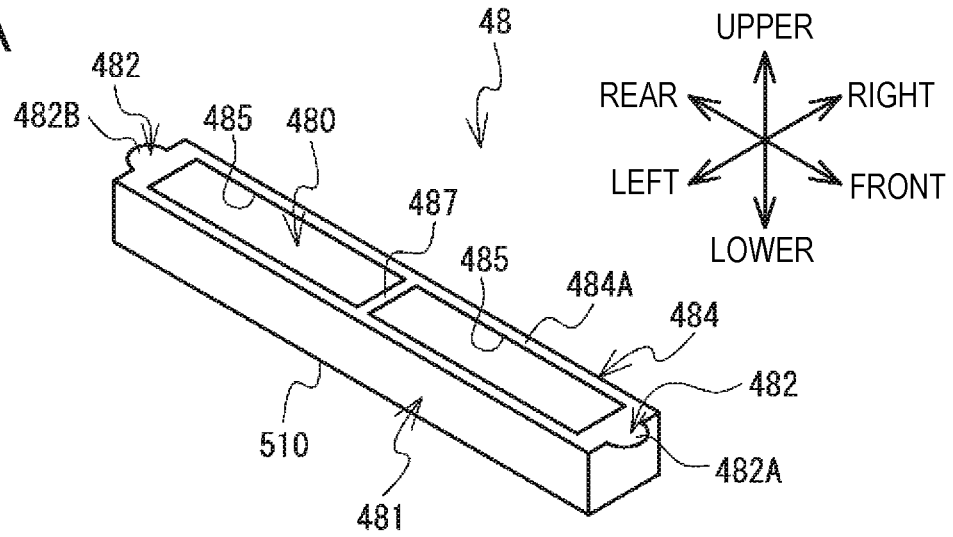
FIGS. 15A and 15B are modifications of the filter unit 48.

The present disclosure can be variously modified from the above embodiment. Various modifications described below can be combined with each other. As shown in FIG. 15A, the filter case 481 may include the handle 482A as a grip portion at a front end portion of the upper case 484, and may include a handle 482B as a grip portion at a rear end portion of the upper case 484. In this case, the handle 482A and the handle 482B may be gripped by respective hands. The handle 482A may protrude forward or upward. The handle 482B may protrude rearward or upward. That is, since the handle 482A provided at the front end portion of the upper case 484 may protrude forward or upward, it may be said that the handle 482A protrudes outward from the filter 480. Since the handle 482B provided at the rear end portion of the upper case 484 may protrude rearward or upward, it may be said that the handle 482B protrudes outward from the filter 480. In addition, the handles 482A, 482B may not have a semicircular shape in a plan view. For example, the shape may be rectangular.

Figure 15B:
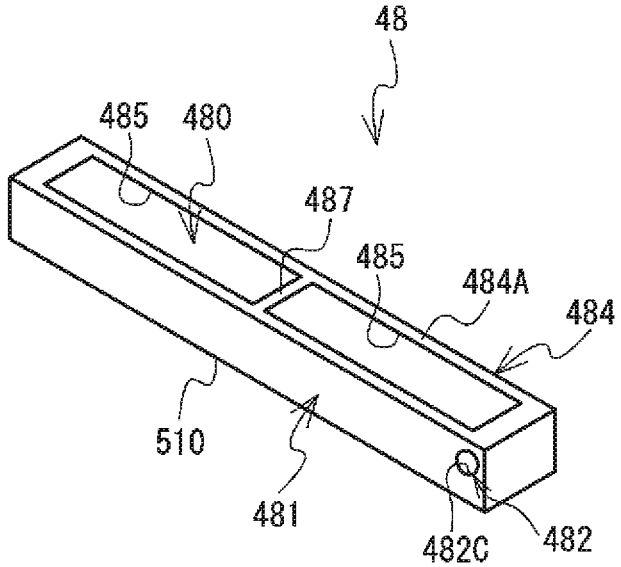

As shown in FIG. 15B, the filter case 481 may be provided with recesses 482C as grip portions on both side surfaces on a front end portion side of the upper case 484, respectively. The recess 482C has a bottom portion and does not penetrate therethrough. Instead of the recess 482C, a penetrating hole may be used. In the present disclosure, the filter case 481 may not be provided. In addition, the handle, the recess and the through hole as the grip portions may not be provided in the filter case 481, may be provided in the filter 480, or may be provided in the lower case 510.

The filter case 481 may not have rigidity higher than that of the filter 480, or may have the same rigidity as that of the filter 480. The number of the extension portions 487 of the upper case 484 is not limited to one, and may be a plurality as long as the extension portions 487 do not interfere with passage of the air containing the mist. The number of the extension portions 513 of the lower case 510 is not limited to three, and may be two, four or the like as long as the extension portions 513 do not interfere with passage of the air containing the mist and can maintain the rigidity of the lower case 510. The extension portion 487 of the upper case 484 and the extension portion 513 of the lower case 510 may extend in an oblique direction with respect to the front-rear direction. The extension portions 487, 513 may not be provided.

Shapes of the first opening edge portion 511 and the second opening edge portion 485 are not limited to rectangles. Opening areas of the openings 511A, 485A formed by the first opening edge portion 511 and the second opening edge portion 485 are preferably large from a viewpoint of ventilation.

The filter 480 may not include the filter case 481 as long as the filter 480 has rigidity that allows the pressing portion 964 to press the actuator 971 of the physical switch 97 by causing the contact portion 962 to come into contact with the filter 480 to rotate the detection lever 961. The filter 480 may be provided with the grip portion 482. The filter case 481 may be formed of a metal material. In this case, the filter case 481 can be repeatedly used by replacing the filter 480.

The physical switch 97 of the sensor 96 may be turned off when the filter 480 is detected, and may be turned on when the filter 480 is not detected. The sensor 96 may include a mechanical switch other than the physical switch 97. The accommodating portion 49, the filter unit 48 and the filter 480 are arranged such that longitudinal directions thereof coincide with the front-rear direction of the printing device 1, but may be arranged such that the longitudinal directions thereof coincide with the left-right direction of the printing device 1. For example, the accommodating portion 49 may be provided on a right side or a left side of the platen opening 13 on a front surface of the main body 10. In this case, the accommodating portion 49 may be provided so as to be able to be pulled out from inside of the printing device 1, and the filter 480 may be able to be attached and detached from the front surface side, or a front panel may be detached and the filter 480 may be able to be attached and detached from the front surface side.

Each of the main scanning direction, the sub-scanning direction and the ejection direction of the printing device 1 may be appropriately changed in any direction of the printing device 1 according to a configuration of the printing device 1.

The shapes, numbers and arrangements of the fans 94, 95, the supply ports 75, 76 and the filter 480 may be changed as appropriate. At least one of the inner walls 71, 72 may be omitted, or the configuration and arrangement thereof may be appropriately changed. For example, the printing device 1 may include one or more fans inside the housing 8, and any one of the fans 94, 95 may be omitted. Although three fans 94 are arranged in the front-rear direction, the number of the fans 94 may be four or more, or may be two or less. The number of the fans 94 and the number of the fans 95 may be the same as each other or may be different from each other. The fan may be provided on only one of the inner walls 71, 72. At least one of the fans 94, 95 may be provided in a space other than the inner walls 71, 72 (for example, the left side space or the right side space). The supply port 75 may be provided between the fan 94 and the head 30.

The program executed by the CPU 81 may be received from other devices via a cable or wireless communication and stored in a nonvolatile storage device. Other devices include, for example, a PC and a server connected via a network.

A part or all of humidification processing executed by the printing device 1 may be executed by an electronic device (for example, an ASIC) different from the CPU 81. The processing executed by the printing device 1 may be distributed processing by a plurality of electronic devices (for example, a plurality of CPUs). An order of steps of the processing executed by the printing device 1 may be changed, the steps may be omitted, and the steps may be added as necessary. A scope of the present disclosure also includes an aspect in which an operating system (OS) or the like running on the printing device 1 executes a part or all of each processing according to a command from the CPU 81.

What is claimed is:

1. A printing device comprising:

an inkjet head;

a filter accommodating portion;

a filter configured to be accommodated in the filter accommodating portion and extending in a given direction from one end to the other end of the filter to collect mist; and a grip portion provided at least one of the one end or the other end of the filter, wherein the grip portion includes a handle protruding from the filter, a recessed portion recessed inside the filter, or a hole, the filter includes a lower case and an upper case, one of the lower case and the upper case including a first opening edge portion, and the other including a second opening edge portion, and at least one of the lower case and the upper case further includes a third opening edge and an extension portion disposed between the first opening edge and the third opening edge.

2. The printing device according to claim 1, wherein the grip portion includes at least one of:

a first handle provided at the other end of the filter and protruding in the given direction or upward, or a second handle provided at the one end of the filter and protruding in a direction opposite to the given direction or upward.

3. The printing device according to claim 1, wherein the filter includes a filter case configured to support an end portion of the filter on which the grip portion is provided, and wherein the grip portion is provided on the filter case.

4. The printing device according to claim 3,
wherein the filter case has rigidity higher than that of the filter.

5. The printing device according to claim 3,
wherein the filter case includes:
the lower case including the first opening edge portion and accommodated in a lower section of the filter accommodating portion, and
the upper case including the second opening edge portion and accommodated in an upper section of the filter accommodating portion, and
wherein the grip portion is provided on the upper case.

6. The printing device according to claim 5, wherein
the lower case includes the extension portion, and
the extension portion extends to and connected to the first opening edge portion at both ends of the lower case.

7. The printing device according to claim 6,
wherein the extension portion extends in the given direction.

8. The printing device according to claim 5, wherein
the upper case includes the extension portion, and
the extension portion extends to and connected to the second opening edge portion at both ends of the upper case.

9. The printing device according to claim 8,
wherein at least one of the extension portion of the lower case or the extension portion of the upper case extends in a direction intersecting the given direction.

10. The printing device according to claim 1, further comprising:
a sensor provided in the filter accommodating portion and configured to detect whether the filter is accommodated in the filter accommodating portion.

11. The printing device according to claim 10, further comprising:
a platen on which a printing medium is to be placed; and
a platen movement controller configured to move the platen when the sensor detects that the filter is accommodated in the filter accommodating portion.

12. The printing device according to claim 10,
wherein the sensor includes a detection lever provided at a position where the detection lever comes into contact with the filter accommodated in the filter accommodating portion.

13. The printing device according to claim 12,
wherein the detection lever is configured to support the filter and come into contact with the filter case having rigidity higher than that of the filter.

14. The printing device according to claim 12,
wherein the filter accommodating portion is movable between an open position and a closed position, and the detection lever moves along an opening and closing direction of the filter accommodating portion.

15. The printing device according to claim 10,
wherein the sensor detects the open position or the closed position of the filter accommodating portion.

16. The printing device according to claim 15, further comprising:
a platen on which a printing medium is to be placed; and
a platen movement controller configured to move the platen when the sensor detects that the filter is accommodated in the filter accommodating portion,
wherein the platen movement controller configured to move the platen when the sensor detects that the filter accommodating portion is at the closed position and the filter is accommodated in the filter accommodating portion.

17. The printing device according to claim 1,
wherein the filter is attachable to and detachable from the filter accommodating portion from a front surface side of the printing device.

18. A filter that is replaceably mounted in a filter accommodating portion of a printing device including an ink jet head and the filter accommodating portion, and collects mist,
wherein the filter extends in a given direction from one end to the other end of the filter, and includes a grip portion provided at least one of the one end or the other end of the filter, and
wherein the grip portion includes a handle protruding from the filter, a recessed portion recessed inside the filter, or a hole,
wherein the filter includes a lower case and an upper case, one of the lower case and the upper case including a first opening edge portion, and the other including a second opening edge portion, and
wherein at least one of the lower case and the upper case further includes a third opening edge and an extension portion disposed between the first opening edge and the third opening edge.

19. The filter according to claim 18,
wherein the grip portion includes at least one of
a first handle provided at the other end of the filter and protruding in the given direction or upward, or
a second handle provided at the one end of the filter and protruding in a direction opposite to the given direction or upward.

20. The filter according to claim 18,
wherein the filter includes a filter case configured to support an end portion of the filter on which the grip portion is provided, and
wherein the grip portion is provided on the filter case.

21. The filter according to claim 20,
wherein the filter case has rigidity higher than that of the filter.

22. The filter according to claim 20,
wherein the filter case includes a lower case including a first opening edge portion, and an upper case including a second opening edge portion, and
wherein the grip portion is provided on the upper case.

23. The filter according to claim 22,
wherein the lower case includes an extension portion extending to and connected to the first opening edge portion at both ends of the lower case.

24. The filter according to claim 23,
wherein the extension portion extends in the given direction.

25. The filter according to claim 22,
wherein the upper case includes an extension portion extending to and connected to the second opening edge portion at both ends of the upper case.

26. The filter according to claim 25,
wherein at least one of the extension portion of the lower case or the extension portion of the upper case extends in a direction intersecting the given direction to be connected to the second opening edge portion at both ends.

27. A printing device comprising:
an inkjet head;
a filter accommodating portion;
a filter configured to be accommodated in the filter accommodating portion and extending in a given direction from one end to the other end of the filter to collect mist;

a grip portion provided at least one of the one end or the other end of the filter;

a sensor provided in the filter accommodating portion and configured to detect whether the filter is accommodated in the filter accommodating portion;

a platen on which a printing medium is to be placed; and a platen movement controller configured to move the platen when the sensor detects that the filter is accommodated in the filter accommodating portion, wherein the grip portion includes a handle protruding from the filter, a recessed portion recessed inside the filter, or a hole.

28. A printing device comprising:

an inkjet head;

a filter accommodating portion;

a filter configured to be accommodated in the filter accommodating portion and extending in a given direction from one end to the other end of the filter to collect mist;

a grip portion provided at least one of the one end or the other end of the filter;

a sensor provided in the filter accommodating portion and configured to detect whether the filter is accommodated in the filter accommodating portion;

a platen on which a printing medium is to be placed; and a platen movement controller configured to move the platen when the sensor detects that the filter is accommodated in the filter accommodating portion, wherein the grip portion includes a handle protruding from the filter, a recessed portion recessed inside the filter, or a hole, the sensor detects the open position or the closed position of the filter accommodating portion, and the platen movement controller configured to move the platen when the sensor detects that the filter accommodating portion is at the closed position and the filter is accommodated in the filter accommodating portion.

* * * * *